US009720372B2

(12) United States Patent
Hiramatsu et al.

(10) Patent No.: US 9,720,372 B2
(45) Date of Patent: Aug. 1, 2017

(54) IMAGE FORMING APPARATUS

(71) Applicant: CANON KABUSHIKI KAISHA, Tokyo (JP)

(72) Inventors: Daisuke Hiramatsu, Numazu (JP); Tetsuya Numata, Suntou-gun (JP); Takayuki Yada, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/948,678

(22) Filed: Nov. 23, 2015

(65) Prior Publication Data

US 2016/0154374 A1 Jun. 2, 2016

(30) Foreign Application Priority Data

Nov. 28, 2014 (JP) ..... 2014-242593

(51) Int. Cl.
*G03G 21/18* (2006.01)

(52) U.S. Cl.
CPC ..... *G03G 21/1839* (2013.01)

(58) Field of Classification Search
USPC ..... 399/110
See application file for complete search history.

(56) References Cited

U.S. PATENT DOCUMENTS 6,064,843 A * 5/2000 Isobe ..... G03G 21/1825 399/111
8,233,820 B2 * 7/2012 Shiraki ..... G03G 21/1821 399/113
2002/0025185 A1 * 2/2002 Ito ..... G03G 21/1882 399/111
2004/0184834 A1 * 9/2004 Blaine ..... G03G 21/1821 399/113
2007/0160380 A1 * 7/2007 Imaizumi ..... G03G 21/1871 399/90

(Continued)

FOREIGN PATENT DOCUMENTS

JP H09-120251 A 5/1997
JP 2002-189401 A 7/2002
JP 2006-071808 A 3/2006

(Continued)

*Primary Examiner* — Clayton E Laballe
*Assistant Examiner* — Linda B Smith
(74) *Attorney, Agent, or Firm* — Canon U.S.A. Inc., IP Division

(57) ABSTRACT

An image forming apparatus includes a cartridge supporting member configured to move with respect to a main body of the apparatus in a state in which a cartridge is mounted to take a mounting and demounting position where the cartridge supporting member is located at an exterior of the main body and allowing the cartridge to be mounted and demounted, and an image forming position where the cartridge supporting member is located within an interior of the main body to locate the cartridge at a position which allows formation of an image. A first unit of the cartridge includes a position-restricted portion, and the cartridge is located below a second unit in which the cartridge is mounted on the cartridge supporting member. The cartridge supporting member includes a position restricting portion configured to restrict movement of the cartridge with respect to the cartridge supporting member by engaging the position-restricted portion.

19 Claims, 36 Drawing Sheets

(56) References Cited

U.S. PATENT DOCUMENTS

| | | | | |
|---|---|---|---|---|
| 2008/0159772 | A1* | 7/2008 | Koishi | G03G 21/1871 399/90 |
| 2009/0110434 | A1* | 4/2009 | Kusudo | G03G 15/0813 399/109 |

FOREIGN PATENT DOCUMENTS

| | | | |
|---|---|---|---|
| JP | 2007-024973 | A | 2/2007 |
| JP | 2008-261910 | A | 10/2008 |
| JP | 2009-157389 | A | 7/2009 |
| JP | 2011-053656 | A | 3/2011 |
| JP | 2013-097185 | A | 5/2013 |

* cited by examiner

IMAGE FORMING APPARATUS

BACKGROUND OF THE INVENTION

Field of the Invention

Technical Field

This disclosure relates to an image forming apparatus. The image forming apparatus is configured to form an image on a recording medium. Examples of the image forming apparatus include, for example, electrophotographic copying machines, electrophotographic printers (such as LED printers, laser beam printers), facsimile apparatuses, and word processors.

Description of the Related Art

Background Art

An electrophotographic image forming apparatus (hereinafter, also referred to simply as "image forming apparatus") is configured to uniformly charge an electrophotographic photosensitive member, that is, a photosensitive drum. The electrophotographic photosensitive member is an image bearing member generally having a drum shape. Next, the charged photosensitive drum is selectively exposed to form an electrostatic latent image (electrostatic image) on the photosensitive drum). The electrostatic latent image formed on the photosensitive drum is then developed as a toner image by using toner as a developer. The toner image formed on the photosensitive drum is transferred to a recording material such as a recording sheet or a plastic sheet, and then heat and pressure are applied to the toner image that has been transferred onto the recording material to fix the toner image to the recording material, thereby completing the image recording.

The image forming apparatus as described above generally needs replenishing of toner and maintenance of various process devices. In order to facilitate replenishing of toner and maintenance described above, a configuration of a process cartridge which accommodates the photosensitive drum, a charging device, a developing device, a cleaning device, and the like in a frame member so as to be mountable and demountable with respect to a main body of the image forming apparatus has already been put into practical use.

According to the cartridge system described above, since a user can perform maintenance of the apparatus on his/her own, operability is significantly improved, and hence an image forming apparatus having superior usability is provided. Therefore, the cartridge system described above is widely used in the field of image forming apparatuses.

The cartridge system described above includes a configuration as disclosed in Japanese Patent Laid-Open No. 2009-157389 in which a tray that is removable from the main body of the image forming apparatus is disposed and a process cartridge can be mounted in a state in which the tray is pulled out from the main body. The image forming apparatus described above has a configuration having high usability because the user is allowed to replace the process cartridge without putting his or her hand into an interior of the main body of the image forming apparatus.

However, with the configuration disclosed in Japanese Patent Laid-Open No. 2009-157389, a space for disposing the tray is required in the interior of the main body of the image forming apparatus, which may result in an increase in the size of the image forming apparatus.

SUMMARY OF THE INVENTION

The present invention provides a configuration in which a cartridge is mounted on a main body of an image forming apparatus by using a cartridge supporting member with the intention of reducing the size of the cartridge supporting member.

According to an aspect of the invention, there is provided an image forming apparatus including: a main body of the apparatus; a cartridge having a first unit and a second unit pivotably coupled to the first unit; and a cartridge supporting member configured to be movable with respect to the main body in a state in which the cartridge is mounted to take a mounting and demounting position where the cartridge supporting member is located at an exterior of the main body and allowing the cartridge to be mounted and demounted and an image forming position where the cartridge supporting member is located within an interior of the main body and configured to locate the cartridge at a position which allows formation of an image, wherein the first unit includes a position-restricted portion, and is located below the second unit in a state in which the cartridge is mounted on the cartridge supporting member, and the cartridge supporting member includes a position restricting portion configured to restrict movement of the cartridge with respect to the cartridge supporting member by coming into contact with the position-restricted portion.

Further features of the present invention will become apparent from the following description of exemplary embodiments with reference to the attached drawings.

DESCRIPTION OF THE EMBODIMENTS

EXAMPLE 1

An embodiment of this disclosure will be described in detail with reference to the drawings below.

A direction of a rotational axis of an electrophotographic photosensitive drum is defined as a longitudinal direction.

In the longitudinal direction, a side on which the photoelectric photosensitive drum receives a drive force from a main body of the image forming apparatus (a side on which a coupling 14 described later is provided on a cartridge B) is defined as a drive-side. An opposite side to the drive-side is defined as a non-drive-side.

A general configuration and an image forming process will be described with reference to FIG. 2 and FIG. 3.

Figure 2:
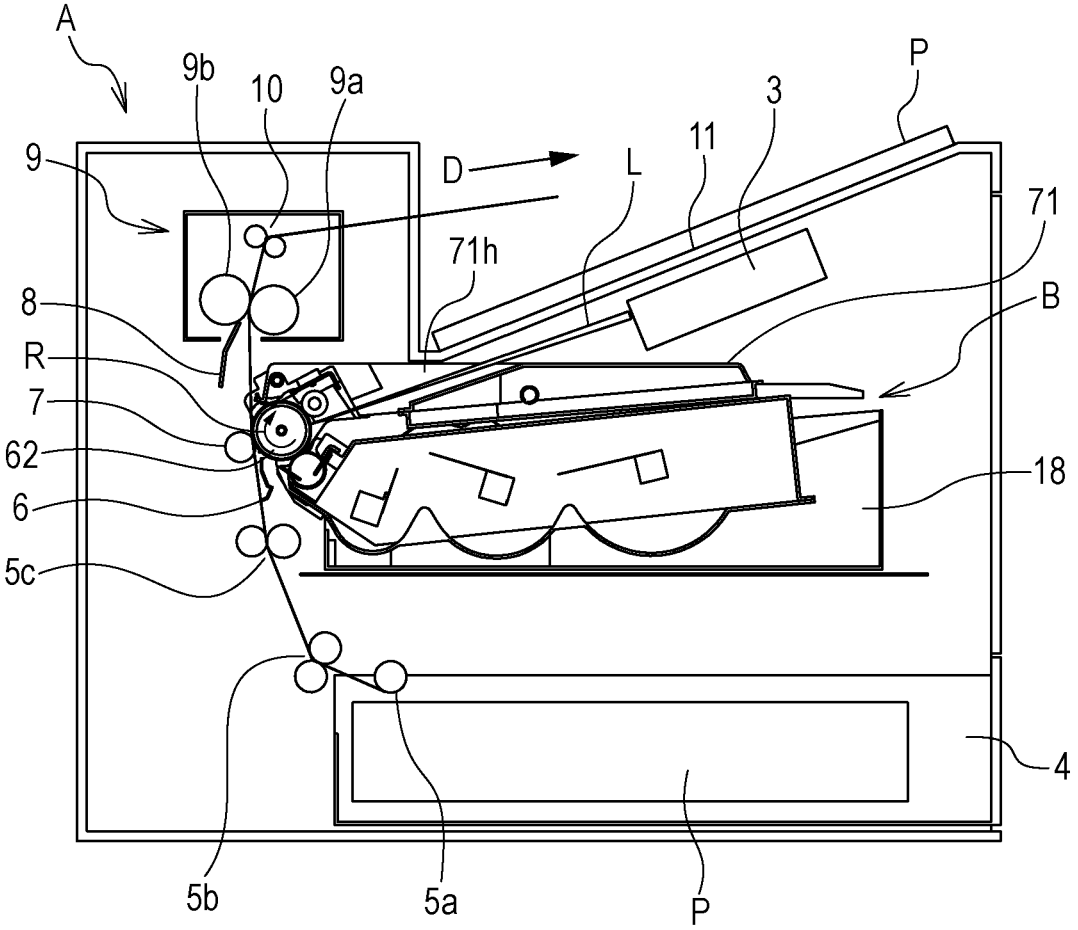
FIG. 2 is a cross-sectional view illustrating the main body and a process cartridge of the electrophotographic image forming apparatus in Example 1.

FIG. 2 is a cross-sectional view illustrating the main body of the electrophotographic image forming apparatus (hereinafter, referred to as a main body A) and a process cartridge (hereinafter, referred to as a cartridge B) as an embodiment of this disclosure.

Figure 3:
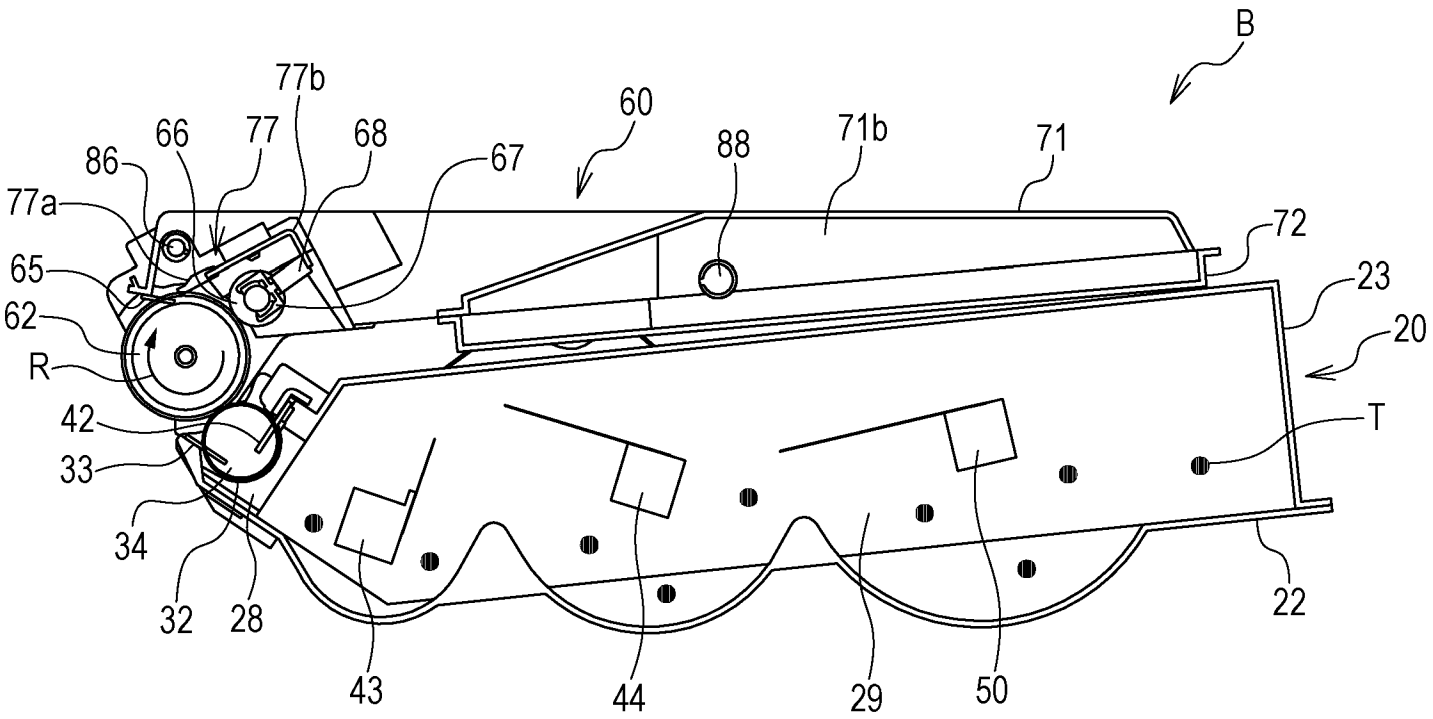
FIG. 3 is a cross-sectional view of the process cartridge in Example 1.

FIG. 3 is a cross-sectional view of the cartridge B.

The term "main body A" here corresponds to a portion of the electrophotographic image forming apparatus excluding the cartridge B and a tray 18 (a detailed description will be given later).

General Configuration of Electrophotographic Image Forming Apparatus

The electrophotographic image forming apparatus illustrated in FIG. 2 is a laser beam printer using an electrophotographic technology. The cartridge B is demountably mounted on the main body A. When the cartridge B is mounted on the main body A, an exposing unit 3 (laser scanner unit) for forming a latent image on an electrophotographic photosensitive drum 62 of the cartridge B is arranged into position. A sheet tray 4 in which recording media (hereinafter, referred to as a sheet material P), which is an object on which an image is formed, is arranged under the cartridge B.

In addition, the main body A includes a pickup roller 5*a*, a feed roller pair 5*b*, a conveyance roller pair 5*c*, a transfer guide 6, a transfer roller 7, a conveyance guide 8, a fixing device 9, a discharge roller pair 10, and a discharge tray 11 arranged in this order in a direction of conveyance D of the sheet material P. The fixing device 9 includes a heating roller 9*a* and a pressure roller 9*b*.

Image Forming Process

Next, the image forming process is described schematically. On the basis of a print start signal, the electrophotographic photosensitive drum (hereinafter, referred to as a drum 62) is driven to rotate at a predetermined circumferential velocity (process speed) in a direction indicated by an arrow R.

A charging roller 66, to which a bias voltage is applied, comes into contact with an outer peripheral surface of the drum 62 and charges an outer peripheral surface of the drum 62 uniformly and evenly.

The exposure device 3 outputs a laser beam L in accordance with image information. The laser beam L passes through a laser opening 71*h* provided in a cleaning frame 71 of the cartridge B and scans and exposes the outer peripheral surface of the drum 62. Accordingly, an electrostatic latent image corresponding to the image information is formed on the outer peripheral surface of the drum 62.

In contrast, as illustrated in FIG. 3, in a first unit as a developing device (hereinafter, referred to as a developing unit 20), toner T in a toner chamber 29 is stirred and conveyed by rotation of a first conveyance member 43, second conveyance member 44, and a third conveyance member 50 and is delivered to a toner supply chamber 28.

The toner T is born on a surface of a developing roller 32 by a magnetic force of a magnet roller 34 (fixed magnet).

The toner T on a peripheral surface of the developing roller 32 is controlled in thickness and, simultaneously, is frictionally charged by a developing blade 42.

The toner T is developed on the drum 62 in accordance with the electrostatic latent image and is visualized as a toner image. In other words, the developing roller 32 is a developer bearing member configured to bear a developer thereon and develop a latent image (electrostatic latent image). The drum 62 is an image bearing member on which latent images are formed and toner images (a developer image) are born.

As illustrated in FIG. 2, the sheet material P stored in a lower portion of the main body A is fed from the sheet tray 4 by the pickup roller 5*a*, the feed roller pair 5*b*, and the conveyance roller pair 5*c* at the same timing as outputting of the laser beam L. Then, the sheet material P passes through the transfer guide 6 and is fed to a transfer position between the drum 62 and the transfer roller 7. At this transfer position, toner images are transferred sequentially from the drum 62 to the sheet materials P.

The sheet material P to which the toner image is transferred is separated from the drum 62 and conveyed to the fixing device 9 along the conveyance guide 8. The sheet material P then passes through a nip portion between the heating roller 9*a* and the pressure roller 9*b* which constitute the fixing device 9. At the nip portion, pressurization and heat-fixation are performed, so that the toner image is fixed to the sheet material P. The sheet material P subjected to the fixation of the toner image is conveyed to the discharge roller pair 10 and is discharged to the discharge tray 11.

In contrast, as illustrated in FIG. 3, residual toner on the outer peripheral surface of the drum 62 after the transfer is removed by a cleaning blade 77, and the drum 62 is used for the image forming process again. The toner removed from the drum 62 is stored in a waste toner chamber 71*b* of a second unit (hereinafter referred to as a cleaning unit 60). The cleaning unit 60 is arranged in a vertical direction over a developing unit (first unit) 20. In other words, the developing unit 20 is arranged under the cleaning unit 60.

In the description given above, the charging roller 66, the developing roller 32, the transfer roller 7, and the cleaning blade 77 correspond to process devices configured to act on the drum 62.

Mounting and Demounting of Cartridge

Mounting and demounting of the cartridge B with respect to the main body A will be described below with reference to FIG. 5 and FIG. 6.

Figure 5:
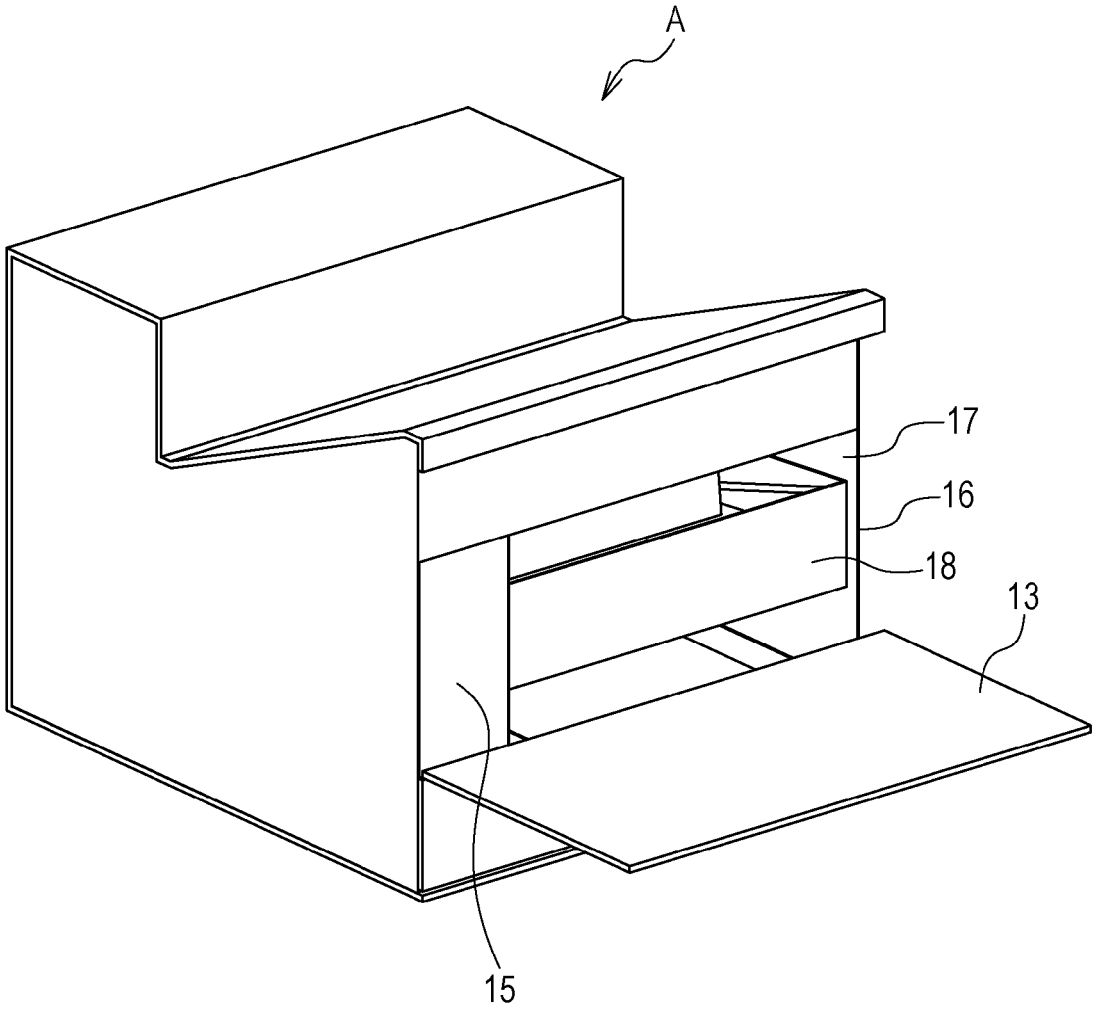
FIG. 5 is a perspective view of the main body of the electrophotographic image forming apparatus in Example 1 in a state in which the opening and closing door thereof is opened.

FIG. 5 is a perspective view of the main body A in a state in which an opening and closing door 13 is opened for mounting and demounting the cartridge B. FIG. 6 is a perspective view of the main body A and the cartridge B in a state in which the opening and closing door 13 is opened and the tray 18 is pulled out for mounting and demounting the cartridge B.

Figure 7:
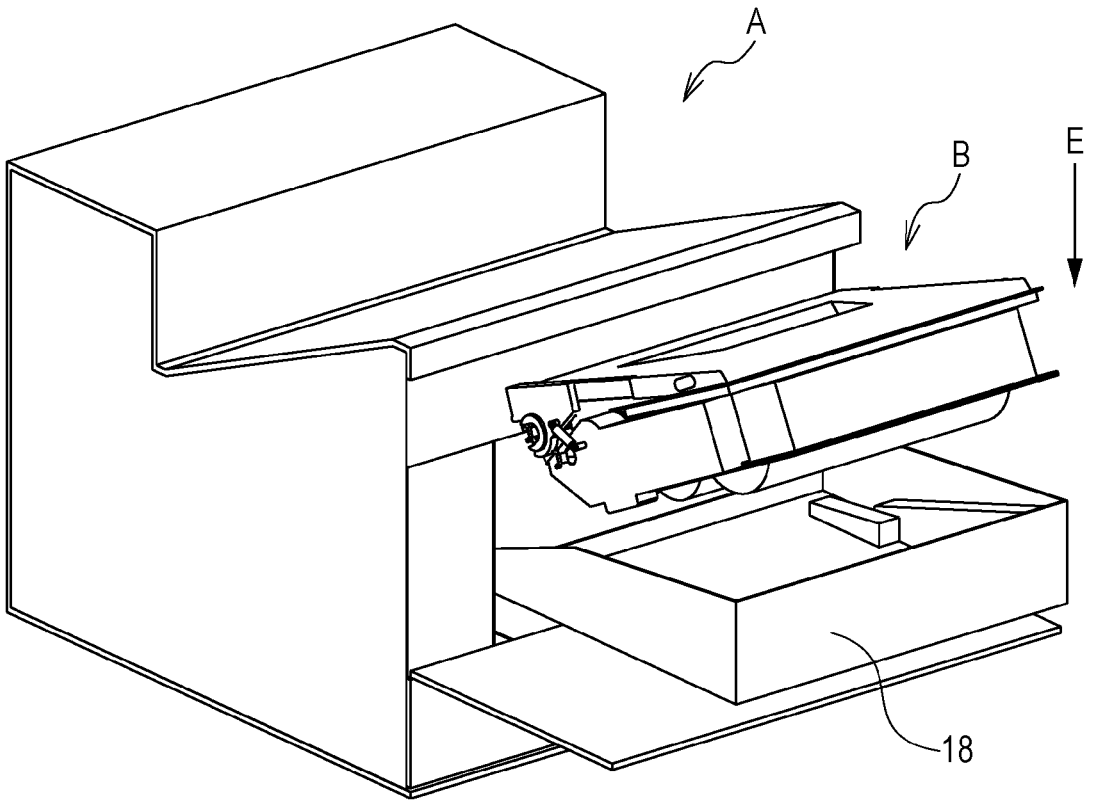
FIG. 7 is a perspective view of the main body of the electrophotographic image forming apparatus and the process cartridge illustrating a state in which the process cartridge is mounted and demounted with respect to the tray in a state in which the opening and closing door of the image forming apparatus in Example 1 is opened and the tray is pulled out.

FIG. 7 is a perspective view of the main body A and the cartridge B when mounting and demounting the cartridge B in a state in which the opening and closing door 13 is opened and the tray 18 is pulled out. The cartridge B is demountably mountable with respect to the tray 18 in a mounting direction E.

The opening and closing door 13 is pivotable with respect to the main body A. When the opening and closing door 13 is opened, a cartridge insertion port 17 is provided. The tray 18 for mounting the cartridge B on the main body A is provided in the cartridge insertion port 17.

The tray 18 is a cartridge supporting member configured to support the cartridge B, and the cartridge B is mounted on the tray 18. In other words, when the tray 18 is pulled out to a predetermined position, mounting and demounting of the cartridge B is enabled. FIG. 6 illustrates a state in which the tray 18 is pulled out to an exterior of main body A (moved to the exterior). In other words, FIG. 6 illustrates a state in which the tray 18 is at a mounting and demounting position (exterior position) for mounting and demounting the cartridge B.

The cartridge B is mounted in the interior of the main body A along a guide rail (not illustrated) in a direction of an arrow C1 (in a first direction) in the drawing in a state of being mounted on the tray 18.

FIG. 5 and FIG. 2 illustrate a state in which the tray 18 is mounted in the interior of the main body A. At this time, the cartridge B mounted on the tray 18 is supported by the main body A and is arranged at a position which enables image formation. In other words, FIG. 5 and FIG. 2 illustrate a state in which the tray 18 is located within the main body A at an image forming position (internal position) which allows the cartridge B to form an image.

In addition, a first drive shaft 14 and a second drive shaft 19 configured to transmit respective drive forces to a first coupling 70 and a second coupling 21 (FIG. 8) provided on the cartridge B are provided. The first drive shaft 14 and the second drive shaft 19 are driven by a motor (not illustrated) of the main body A. Accordingly, the drum 62 coupled to the first coupling 70 receives a drive force from the main body A and rotates. The developing roller 32 rotates upon reception of a drive source from the second coupling 21. The charging roller 66 and the developing roller 32 receive a supply of electricity from a power feeding unit (not illustrated) of the main body A.

Supporting of Cartridge

Figure 8:
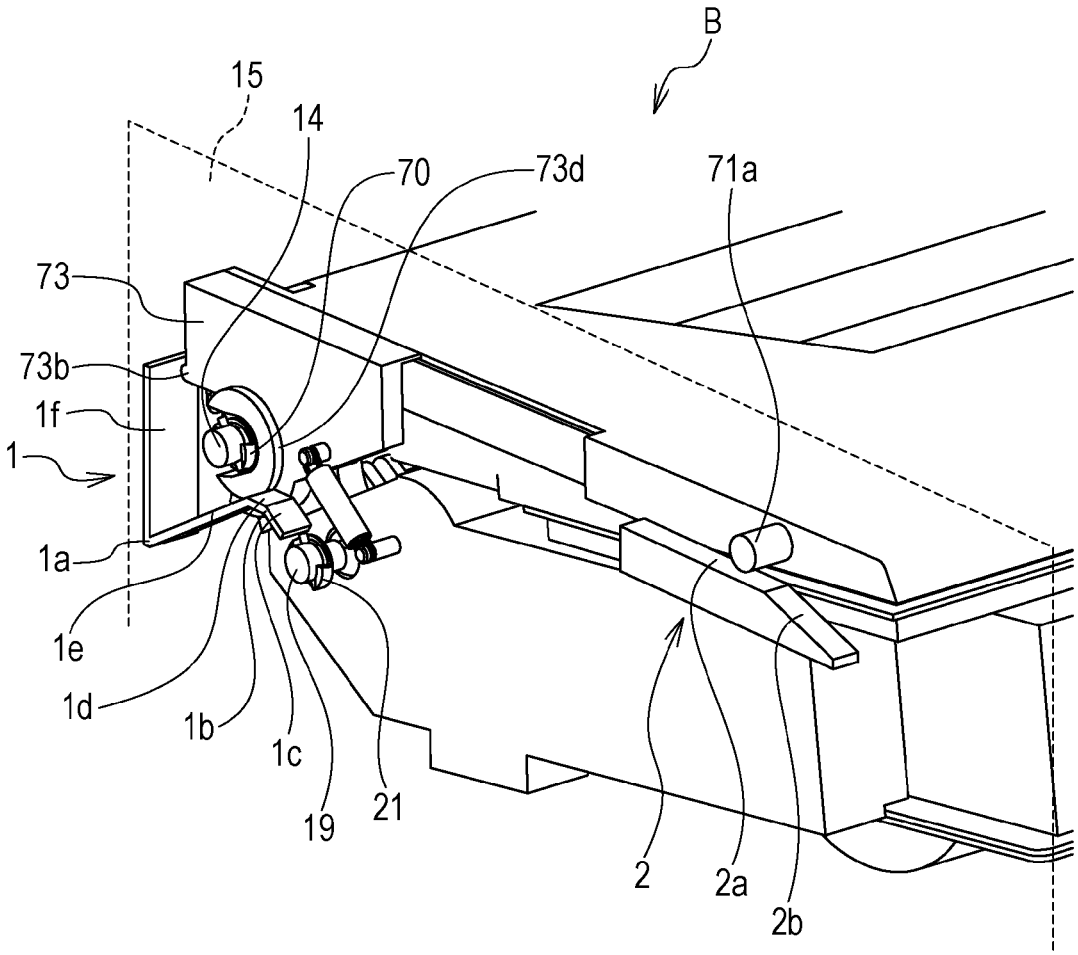
FIG. 8 is a perspective view of the process cartridge and drive-side supporting portions of the main body of the image forming apparatus in a state in which the process cartridge is mounted on a main body of the electrophotographic image forming apparatus in Example 1.

As illustrated in FIG. 5, the main body A is provided with a drive-side panel 15 and a non-drive-side panel 16 for supporting the cartridge B. As illustrated in FIG. 8, the drive-side panel 15 is provided with a drive-side supporting portion 1 and a drive-side rotation-restricting portion 2 for supporting the cartridge B.

The drive-side supporting portion 1 includes a supporting portion 1*a* and a first guide portion (first body-side guide portion) 1*b* formed integrally with each other. The drive-side rotation-restricting portion 2 includes a rotation restricting surface 2*a* and a second guide portion (second body-side guide portion) 2*b* formed integrally with each other. The supporting portion 1*a* includes supporting surfaces 1*f* and 1*e*. The first guide portion 1*b* includes guide surfaces 1*c* and 1*d*.

Figure 9:
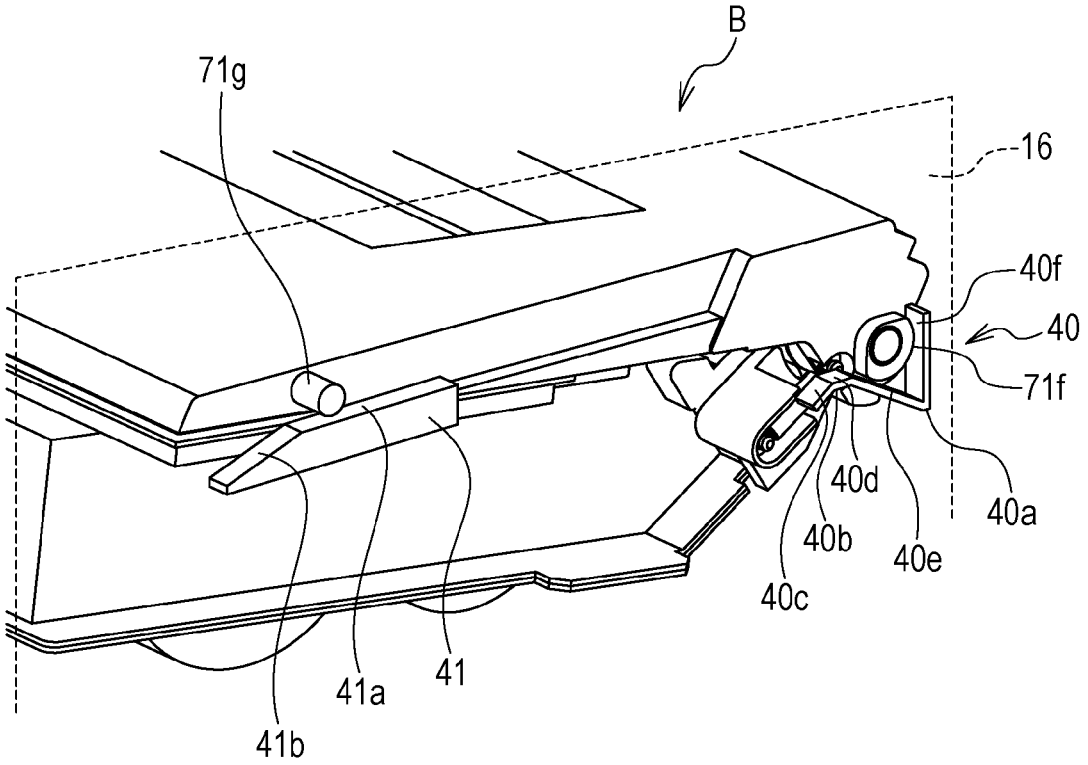
FIG. 9 is a perspective view of the process cartridge and non-drive-side supporting portions of the main body of the image forming apparatus in the state in which the process cartridge is mounted on the main body of the electrophotographic image forming apparatus in Example 1.

In the same manner, as illustrated in FIG. 9, a non-drive-side supporting portion 40 and a non-drive-side rotation-restricting portion 41 are provided in the non-drive-side panel 16. The non-drive-side supporting portion 40 includes a supporting portion 40*a* and a first guide portion (first body-side guide portion) 40*b* formed integrally with each other. The non-drive-side rotation-restricting portion 41 includes a rotation restricting surface 41*a* and a second guide portion (second body-side guide portion) 41*b* formed integrally with each other. The supporting portion 40*a* includes a supporting surface 40*f* and a supporting surface 40*e*. The first guide portion 40*b* includes guide surfaces 40*c* and 40*d*.

In contrast, supported portions of the cartridge B include a supported portion 73*b*, a supported portion 73*d* of a drum bearing 73, and a non-drive-side projecting portion 71*f*.

The cleaning unit 60 includes a drive-side boss 71*a* and a non-drive-side boss 71*g* as rotation-restricted portions.

The supported portion 73*b* and the supported portion 73*d* are supported by the supporting surface 1*f* and the supporting surface 1*e*, respectively.

The drive-side boss 71*a* is supported by the rotation restricting surface 2*a*. In the same manner, the non-drive-side projecting portion (supported portion) 71*f* is supported by a non-drive-side first supporting portion 40*f* and a non-drive-side second supporting portion 40*e*. The non-drive-side boss 71*g* is supported by the rotation restricting surface 41*a*. In this configuration, the cartridge B is positioned within the main body A.

In other words, the supported portions (the supported portions 73*b* and 73*d* and a projecting portion 71*f*) of the cartridge B are supported by supporting portions (supporting portions 1*a* and 40*a*) of the main body A. Accordingly, the drum 62 (FIG. 2) of the cartridge B is positioned at a position where image formation is enabled. In this state, the rotation-restricted portions of the cartridge B (the drive-side boss 71*a*, the non-drive-side boss 71*g*) come into contact with rotation-restricting portions 2, 41 of the main body A. Therefore, rotation of the cartridge B about the supporting portions (supporting portions 1*a* and 40*a*) as supporting points (center) is also restricted. The posture of the cartridge is retained, and positioning of the entire part of the cartridge B is achieved.

Configuration of Cartridge as a Whole

Figure 10:
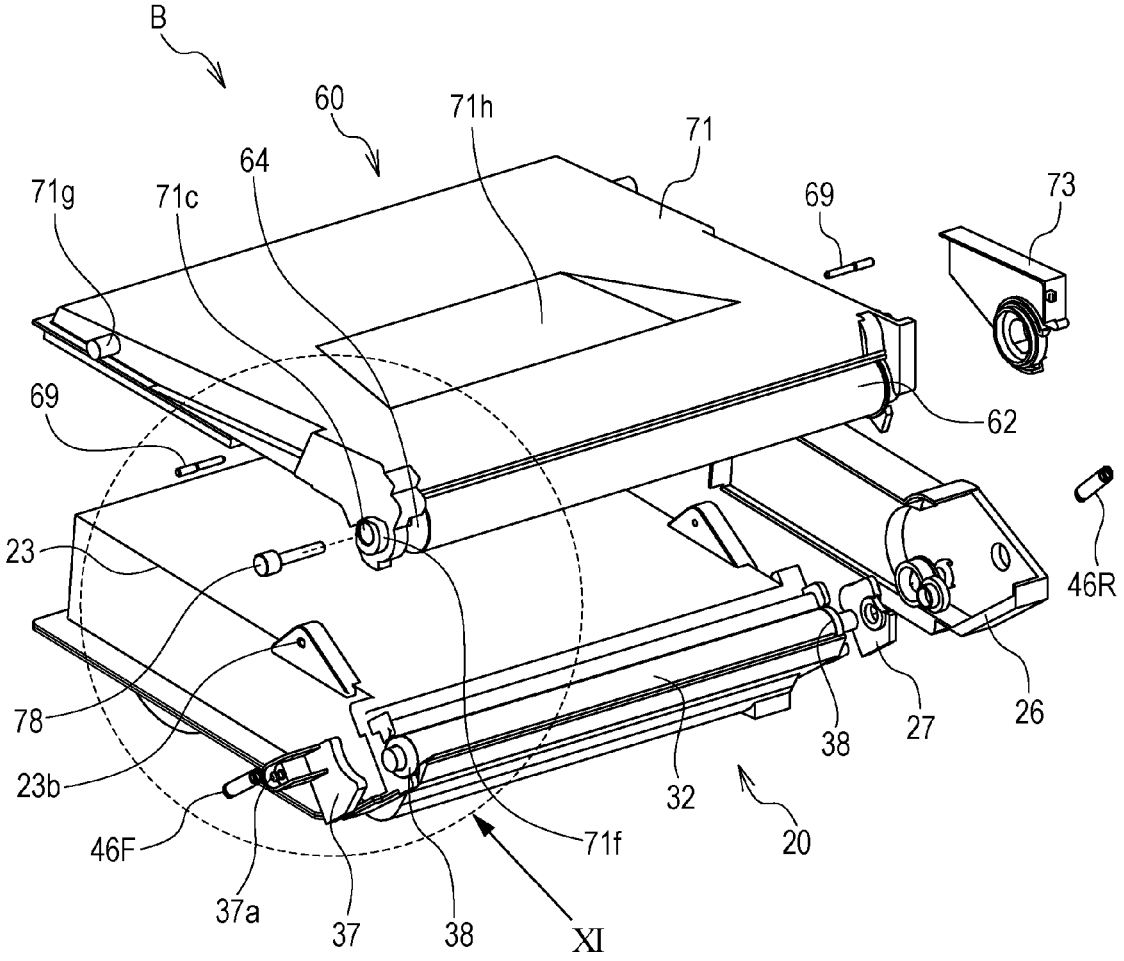
FIG. 10 is an exploded view illustrating the process cartridge in Example 1.
Figure 11:
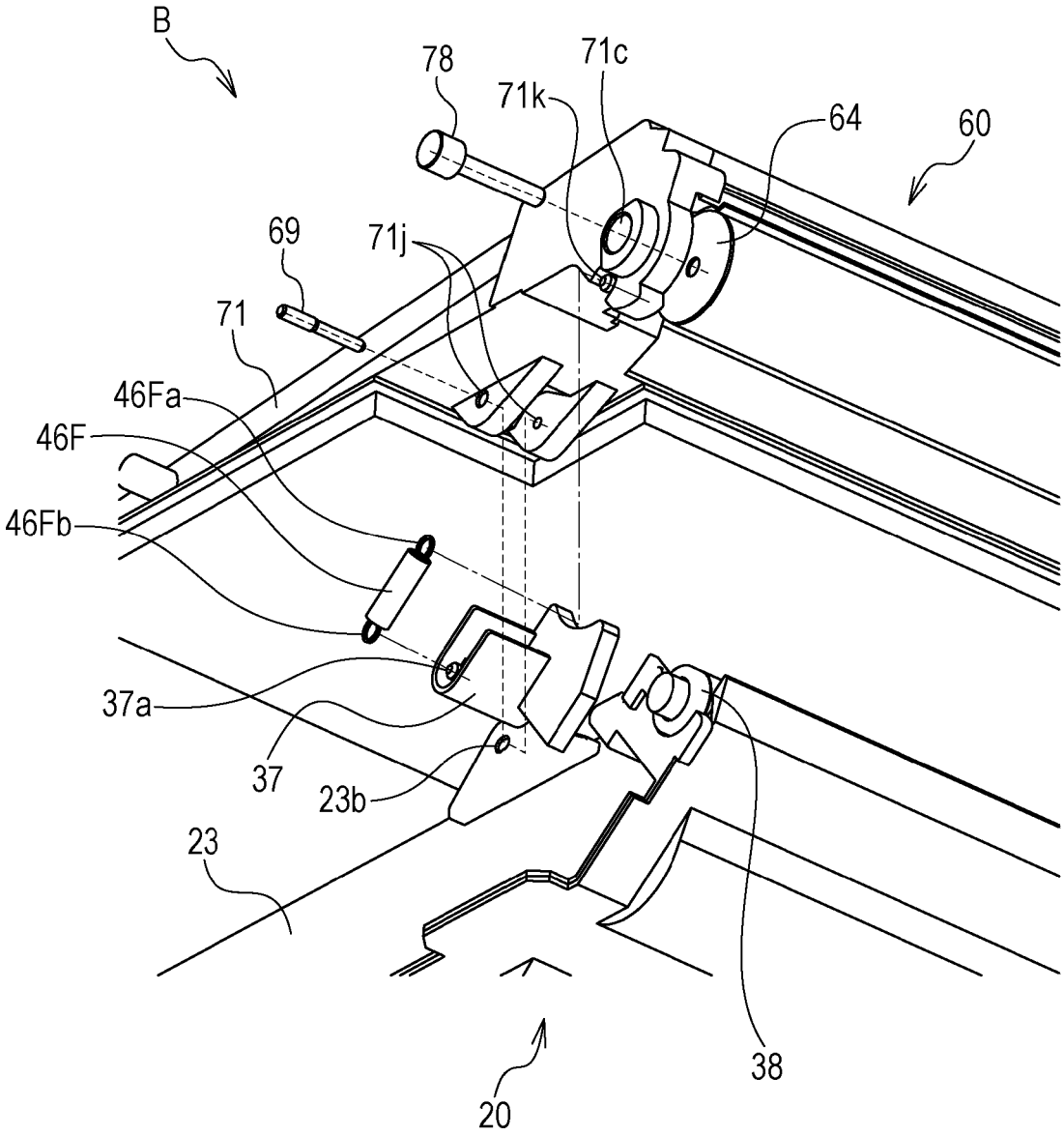
FIG. 11 is an exploded view illustrating the process cartridge in Example 1.
Figure 12:
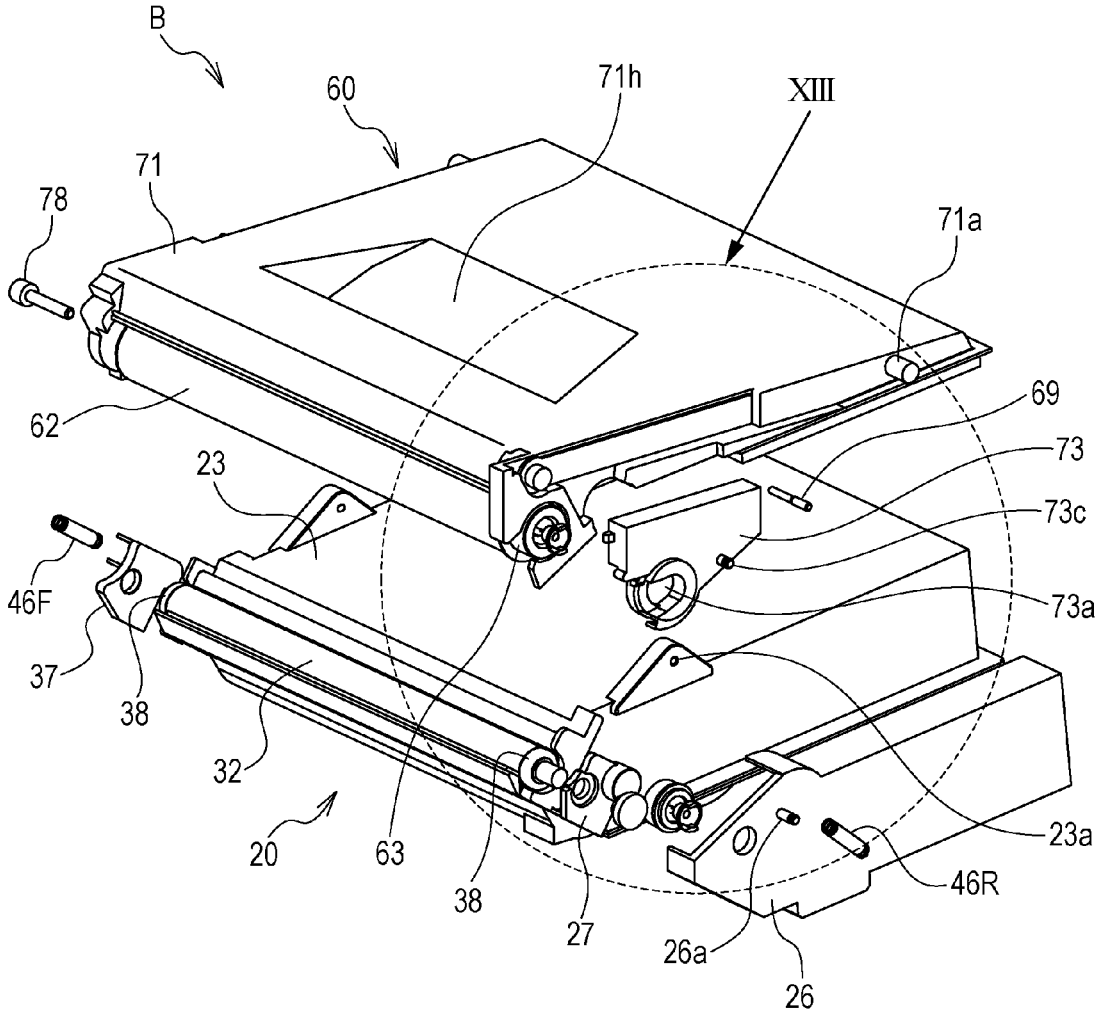
FIG. 12 is an exploded view illustrating the process cartridge in Example 1.
Figure 13:
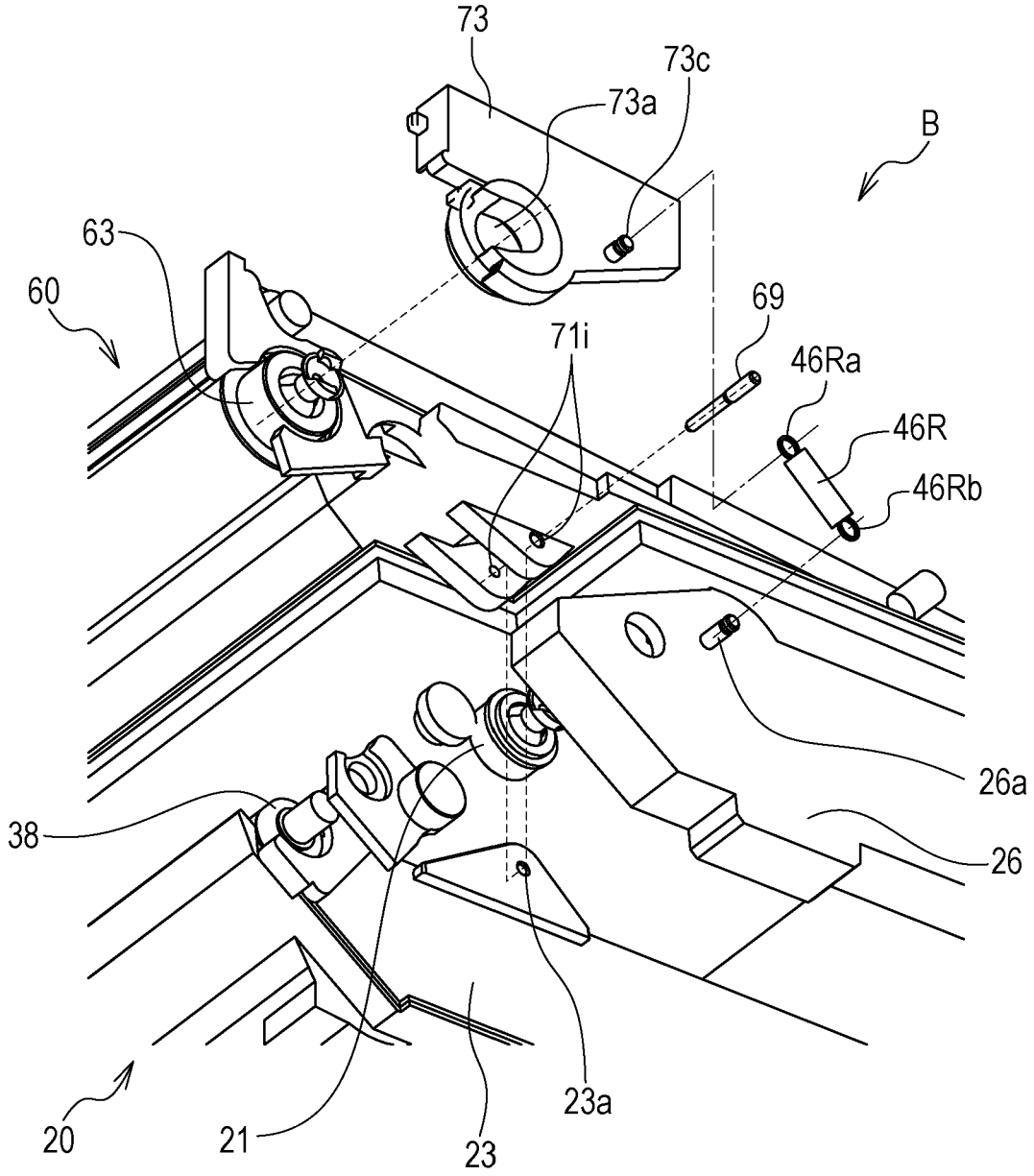
FIG. 13 is an exploded view illustrating the process cartridge in Example 1.

A general configuration of the cartridge B will be described with reference to FIG. 3, FIGS. 4A and 4B, FIG. 10, FIG. 11, FIG. 12, and FIG. 13 below. FIG. 3 is a cross-sectional view of the cartridge B, FIG. 10, FIG. 11, FIG. 12, and FIG. 13 are perspective views for explaining a configuration of the cartridge B. FIG. 11 and FIG. 13 are partly enlarged drawings illustrating portions within dot lines XI, XIII in FIG. 10 and FIG. 12 viewed from a different angle in an enlarged scale. In this example, a description of screws used for coupling components is omitted.

The cartridge B includes the cleaning unit 60 and the developing unit 20. In general, the process cartridge includes an electrophotographic photosensitive member and at least one of a charging device, a developing device, and a cleaning device as process devices configured to act integrally on the electrophotographic photosensitive member to form a cartridge so as to be mountable on and demountable from the main body of the electrophotographic image forming apparatus.

As illustrated in FIG. 3, the cleaning unit 60 includes the drum 62, the charging roller 66, a cleaning member 77, the cleaning frame 71 configured to support these members, and a lid member 72 fixed to the cleaning frame 71 by welding or the like. In the cleaning unit 60, the charging roller 66 and the cleaning member 77 are arranged to be in contact with an outer peripheral surface of the drum 62.

The cleaning member 77 includes a rubber blade 77*a*, which is a blade-shaped resilient member formed of rubber as a resilient material, and a supporting member 77*b* configured to support the rubber blade 77*a*. The rubber blade 77*a* is in contact with the drum 62 in a counter direction with respect to the direction of rotation of the drum 62. In other words, the rubber blade 77*a* is in contact with the drum 62 so that a distal end portion thereof faces upstream of the direction of rotation of the drum 62.

Figure 4A:
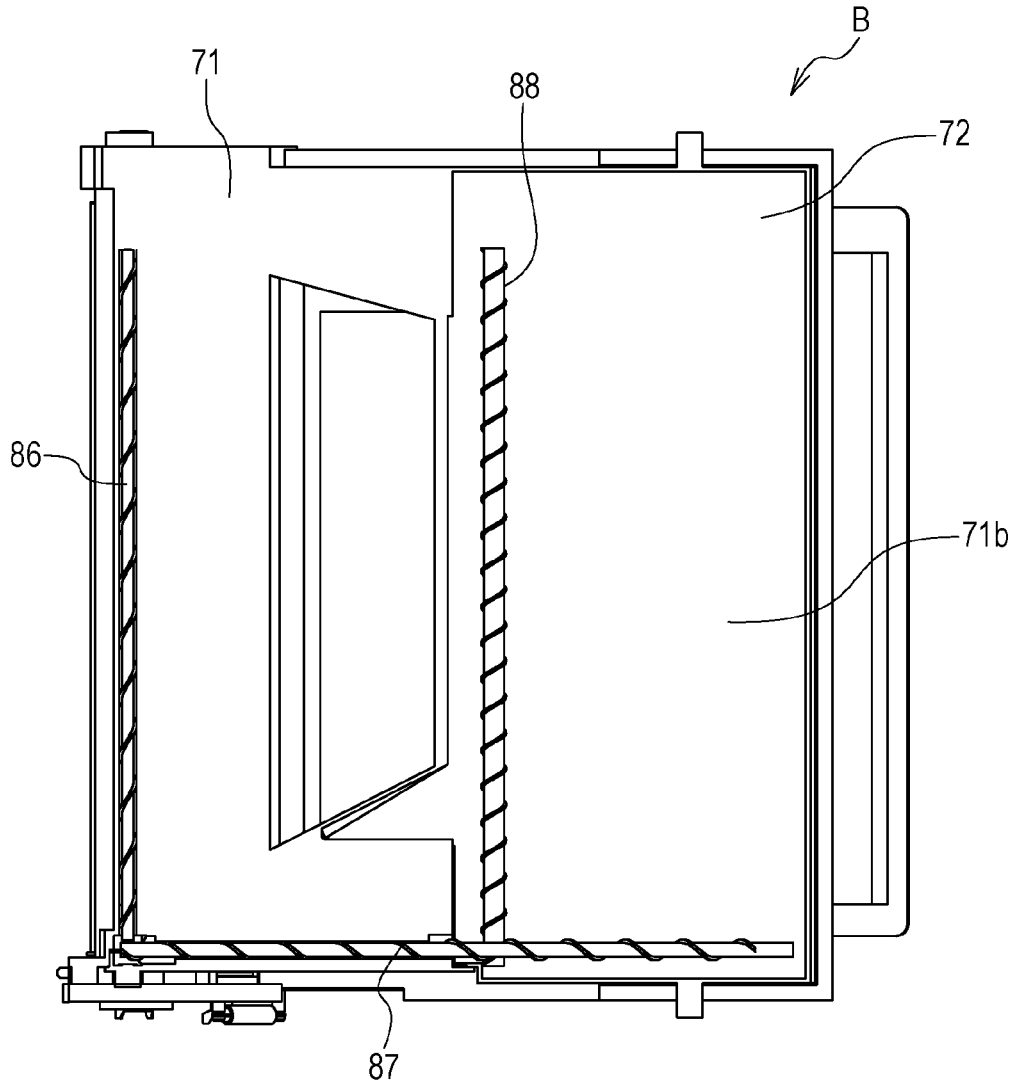
FIG. 4A is a cross-sectional view taken along the line IVA-IVA in FIG. 4B illustrating an interior of the cleaning container of the process cartridge in Example 1.
Figure 4B:
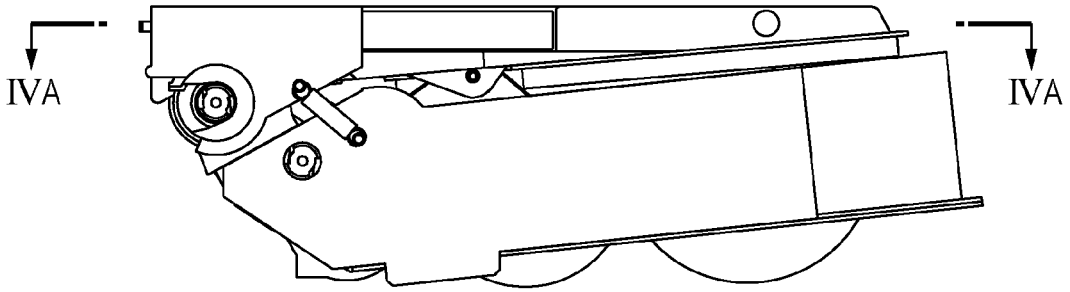
FIG. 4B is a side view of the process cartridge in Example 1.

FIG. 4A is a cross-sectional view illustrating an interior of the cleaning frame 71. As illustrated in FIG. 3 and FIG. 4A, waste toner removed from the surface of the drum 62 by the cleaning member 77 is conveyed by a first screw 86, a second screw 87, and a third screw 88 as waste toner conveyance members. The conveyed toner is accumulated in the waste toner chamber 71*b* formed by the cleaning frame and the lid member. The first screw 86 is rotated by a gear (not illustrated) upon transmission of a drive force from the coupling 21 illustrated in FIG. 13. The second screw 87 is rotated by a drive force from the first screw 86, and the third screw 88 is rotated by a drive force from the second screw 87. The first screw 86 is arranged in the vicinity of the drum 62, the second screw 87 is arranged at an end portion in the longitudinal direction of the cleaning frame 71, and the third screw 88 is arranged in the waste toner chamber 71*b*. Here, the rotation axes of the first screw 86 and the third screw 88 are parallel to a rotation axis of the drum 62, and a rotation axis of the second screw 87 is orthogonal to the rotation axis of the drum 62.

As illustrated in FIG. 3, a scooping sheet 65 for preventing waste toner from leaking out from the cleaning frame 71 is provided at an edge portion of the cleaning frame 71 so as to come into contact with the drum 62.

The drum 62 receives a drive force from a main body drive motor (not illustrated) as a drive source and is rotated thereby in a direction indicated by the arrow R in the drawing in accordance with an image forming action.

The charging roller 66 is rotatably mounted on the cleaning unit 60 via a charging roller bearing 67 at both end portions in a longitudinal direction of the cleaning frame 71 (substantially parallel to the direction of an axis of rotation of the drum 62). The charging roller 66 is in press contact with the drum 62 by the charging roller bearing 67 which is pressed by a biasing member 68 toward the drum 62. The charging roller 66 is rotated by the rotation of the drum 62.

As illustrated in FIG. 3, the developing unit 20 includes the developing roller 32, a developer container 23 configured to support the developing roller 32, and the developing blade 42. The magnet roller 34 is provided in the developing roller 32. The developing blade 42 for controlling the toner layer on the developing roller 32 is arranged in the developing unit 20. As illustrated in FIG. 10 and FIG. 12, the developing roller 32 includes distance retaining members 38 mounted on both end portions of the developing roller 32, and the distance retaining members 38 come into contact with the drum 62, so that the developing roller 32 is retained apart from the drum 62 with small gaps therebetween. As illustrated in FIG. 3, a blow-out preventing sheet 33 for preventing toner from leaking out from the developing unit 20 is provided at an edge portion of a bottom member 22 so as to come into contact with the developing roller 32. In addition, the first conveyance member 43, the second conveyance member 44, and the third conveyance member 50 are provided in the toner chamber 29 formed by the developer container 23 and the bottom member 22. The first conveyance member 43, the second conveyance member 44, and the third conveyance member 50 stir toner stored in the toner chamber 29, and convey the toner to the toner supply chamber 28.

As illustrated in FIG. 10 and FIG. 12, the cartridge B includes the cleaning unit 60 and the developing unit 20 combined with each other.

The cleaning unit 60 includes the cleaning frame 71, the lid member 72, the drum 62, the drum bearing 73 configured to rotatably support the drum 62, and a drum shaft 78. As illustrated in FIG. 13, on the drive-side, the drum 62 is rotatably supported by a drive-side drum flange 63 provided on the drive-side fitted in a hole portion 73*a* of the drum bearing 73. In contrast, as illustrated in FIG. 11, on the non-drive-side, the drum shaft 78 press-fitted into a hole portion 71*c* provided in the cleaning frame 71 rotatably supports the hole portion (not illustrated) of a non-drive-side drum flange 64.

In contrast, as illustrated in FIG. 3, FIG. 10, and FIG. 12, the developing unit 20 includes the bottom member 22, the developer container 23, a drive-side development side member 26, the developing blade 42, and the developing roller 32. The developing roller 32 is rotatably mounted on the developer container 23 by bearing members 27 and 37 provided at both ends thereof.

As illustrated in FIG. 11 and FIG. 13, the cleaning unit 60 and the developing unit 20 are pivotably coupled to each other by coupling pins 69 to constitute part of the cartridge B. The developing unit 20 is pivotable with respect to the cleaning unit 60 about the coupling pins 69.

Specifically, a first supporting hole 23*a* and a second supporting hole 23*b* are provided in the developer container 23 at both end portions in the longitudinal direction of the developing unit 20. A first hanging holes 71*i* and a second hanging holes 71*j* are provided in the cleaning frame 71 at both end portions in the longitudinal direction of the cleaning unit 60. The coupling pins 69 fixedly press-fitted to the first hanging holes 71*i* and the second hanging holes 71*j* are fitted into the first supporting hole 23*a* and the second supporting hole 23*b*, so that the cleaning unit 60 and the developing unit 20 are coupled pivotably with respect to each other.

A first hole portion 46Ra of a drive-side biasing member 46R is hooked on a boss 73*c* of the drum bearing 73, and a second hole portion 46Rb is hooked on a boss 26*a* of the drive-side development side member 26.

A first hole portion 46Fa of a non-drive-side biasing member 46F is hooked on a boss 71*k* of the cleaning frame 71 and a second hole portion 46Fb is hooked on a boss 37*a* of a bearing member 37.

In this example, the drive-side biasing member 46R and the non-drive-side biasing member 46F are each formed of a tension coil. With biasing forces of these springs, the developing unit 20 is biased toward the cleaning unit 60, thereby reliably pressing the developing roller 32 against the drum 62. With distance retaining members 38 mounted on both end portions of the developing roller 32, the developing roller 32 is retained at a predetermined distance from the drum 62.

Mounting and Demounting of Cartridge with Respect to Tray

As described above, mounting and demounting of the cartridge B with respect to the main body A is performed in a state in which the cartridge B is mounted on the tray 18.

Figure 14:
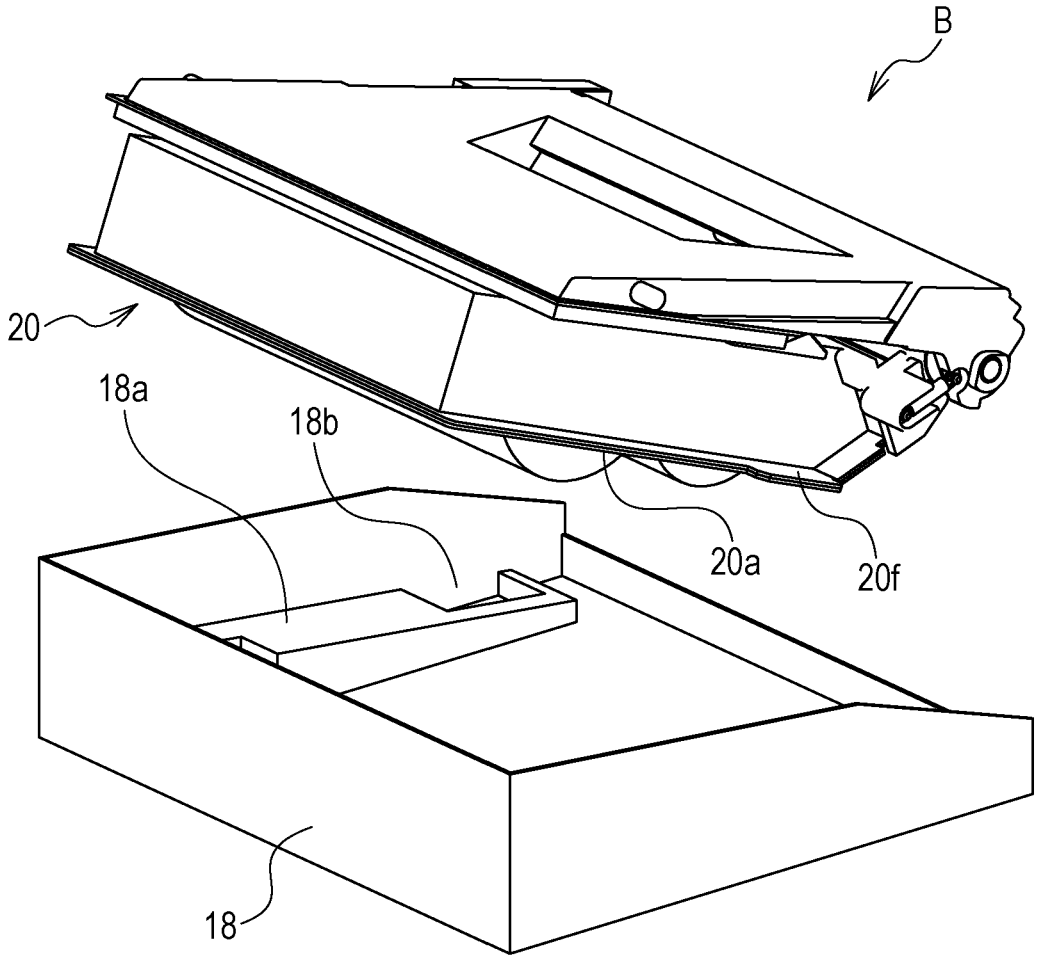
FIG. 14 is a perspective view illustrating a state of mounting the process cartridge on the tray in Example 1.
Figure 15:
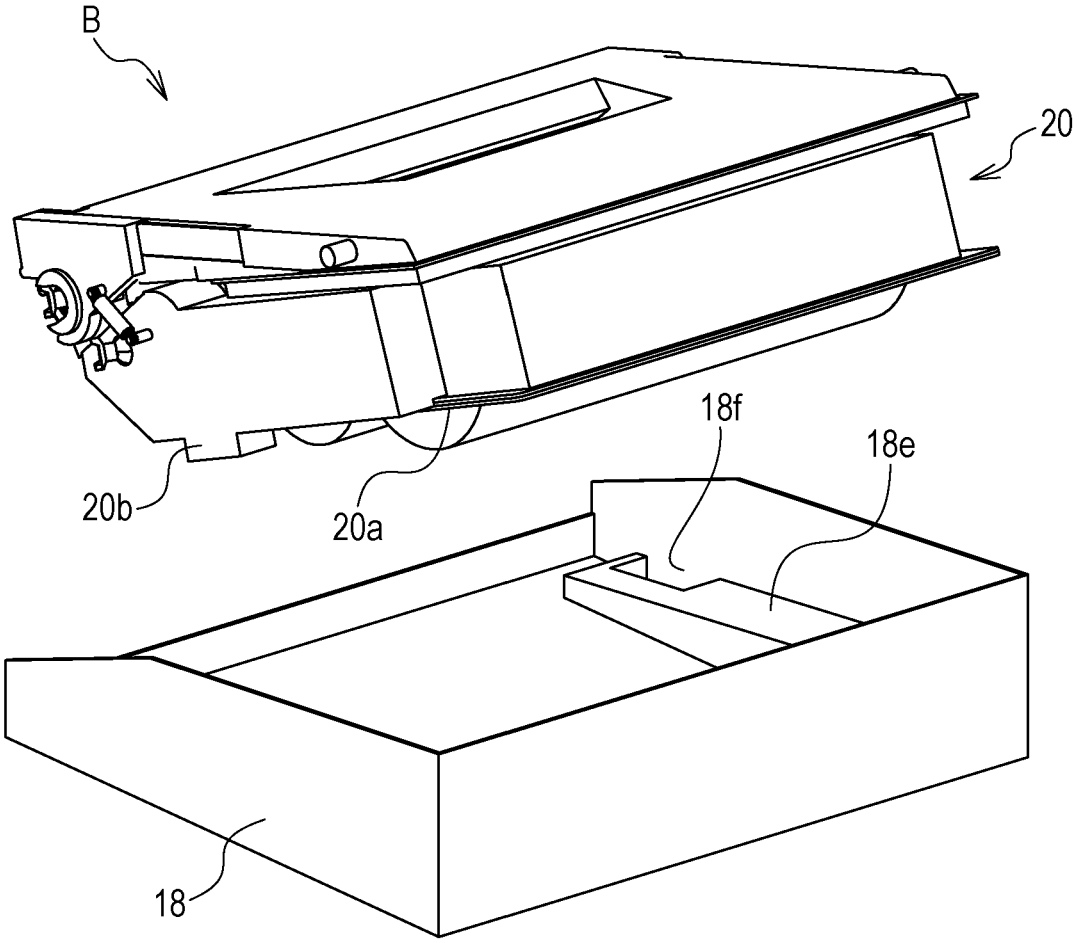
FIG. 15 is a perspective view illustrating the state of mounting the process cartridge on the tray in Example 1.

Mounting and demounting of the cartridge B with respect to the tray 18 will be described. FIG. 14 and FIG. 15 are perspective views illustrating components of the cartridge B and the tray 18. FIG. 16, FIG. 17, FIG. 18, and FIG. 19 are schematic illustrations of a positional relationship between the cartridge B and the tray 18 at the time of mounting and demounting illustrated in chronological order.

Figure 16:
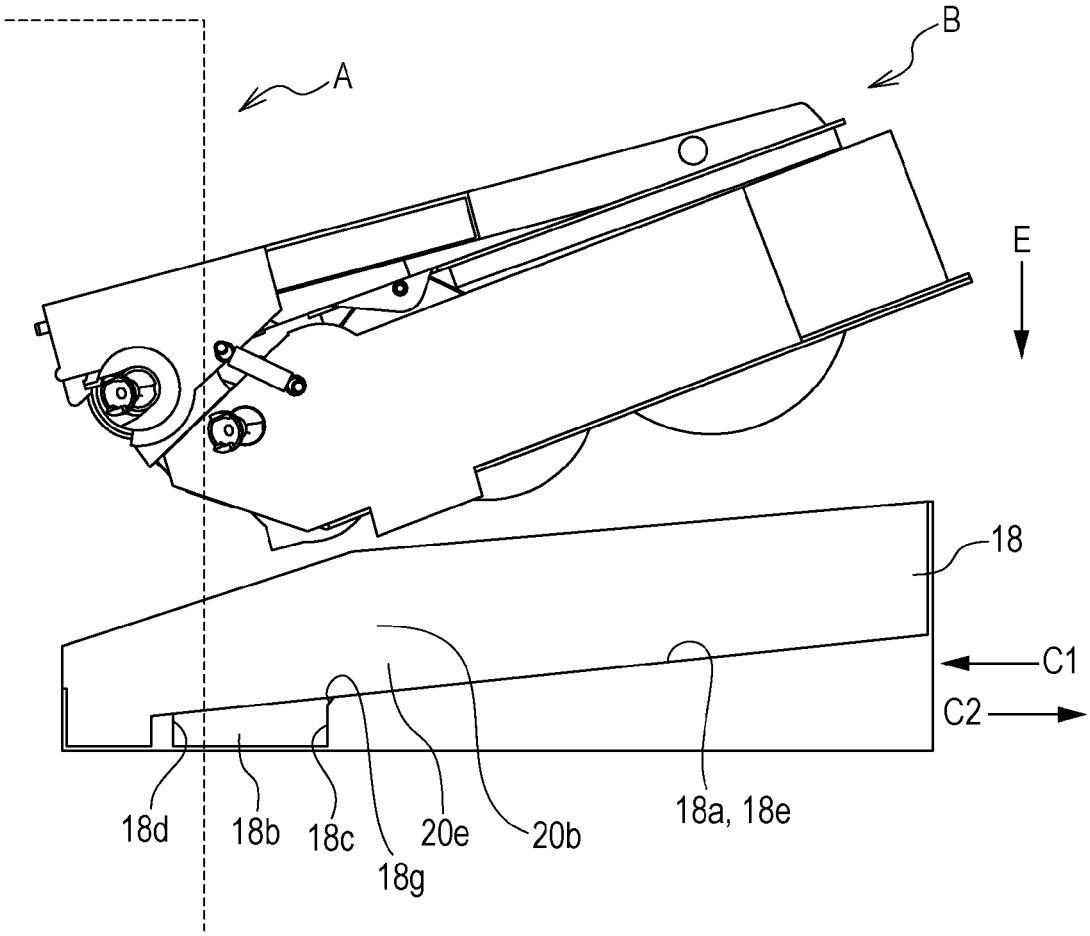
FIG. 16 is a cross-sectional view of the tray in the state of mounting the process cartridge on the tray in Example 1.

A configuration of the tray 18 will be described in detail with reference to FIG. 14, FIG. 15, and FIG. 16. The tray 18 is provided with supporting surfaces 18*a* and 18*e* configured to support a supported surface 20*a* provided on the developing unit 20. The supporting surfaces 18*a* and 18*e* are configured to be inclined downward toward the downstream side in a direction of tray insertion C1 as illustrated in FIG. 16. As illustrated in FIG. 14 and FIG. 15, the tray 18 is provided with position restricting portions 18*b* and 18*f* configured to engage position-restricted portions 20*b* and 20*f* disposed on a bottom surface of the developing unit 20. The position restricting portions 18*b* and 18*f* are configured to suppress the movement of the cartridge B with respect to the tray 18 in a direction indicated by an arrow C1 in FIG. 16 (first direction) and a direction (second direction) C2 of pulling out of the tray in FIG. 16 (restricts the movement).

The position restricting portion 18*b* includes a first contact surface 18*c* and a second contact surface 18*d*. A portion between the first contact surface 18*c* and the second contact surface 18*d* corresponds to a space that the position-restricted portion 20*b* enters (opening portion or groove portion).

The function of the position restricting portion 18*f* is the same as that of the position restricting portion 18*b*. In this example, only the position restricting portion 18*b* projects downward. However, any of the position restricting portions 18*b* and 18*f* may project downward as long as at least one of these position restricting portions projects downward. Mounting and demounting of the cartridge B with respect to the tray 18 will be described next with reference to FIG. 16, FIG. 17, and FIG. 18. Configurations of the tray 18 and the developing unit 20 described above are provided on both end portions in the longitudinal direction. However, only those on the drive-side will be described below because these members function the same on both sides.

Figure 17:
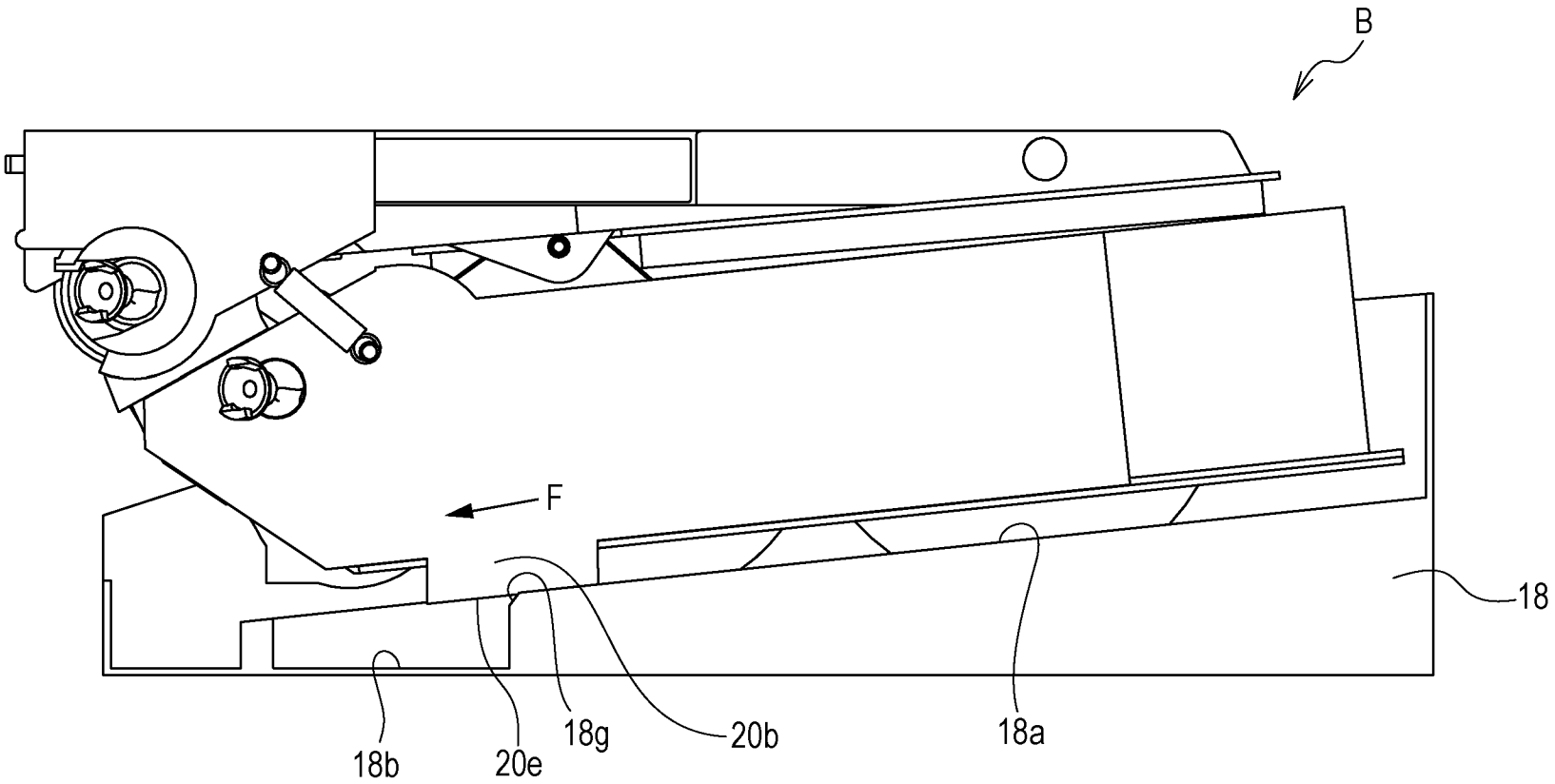
FIG. 17 is a cross-sectional view of the tray in the state of mounting the process cartridge on the tray in Example 1.

FIG. 16 illustrates a state in which the opening and closing door 13 (see FIG. 6) is opened, the tray 18 is pulled out from the image forming position and is at a mounting and demounting position at which the cartridge B can be mounted and demounted with respect to the tray 18. In FIG. 16, when a user grips a grip, which is not illustrated, and mounts the cartridge B on the tray 18 in a direction indicated by an arrow E in FIG. 16, a bottom surface 20*e* of the position-restricted portion 20*b* comes into contact with the supporting surface 18*a* as illustrated in FIG. 17. At this time, the supporting surface 18*a* is inclined, and the user is allowed to move the cartridge B in a direction indicated by an arrow F in FIG. 17 in a state in which the position-restricted portion 20*b* is in contact with the supporting surface 18*a*.

In other words, the supporting surface 18*a* is a guide (supporting-member-side guide portion) configured to come into contact with the position-restricted portion 20*b* to guide the cartridge B to be mounted on the tray 18.

Figure 18:
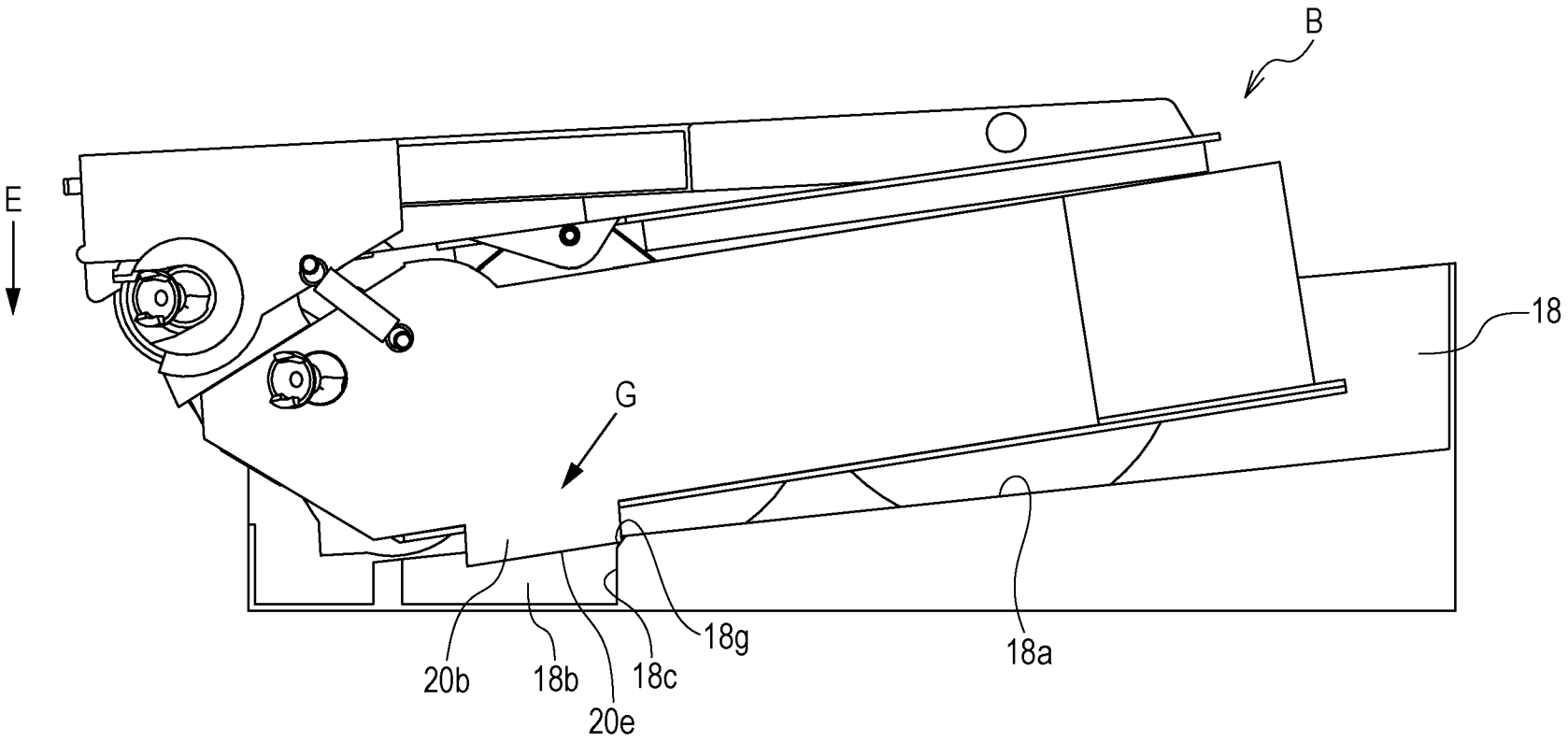
FIG. 18 is a cross-sectional view of the tray in the state of mounting the process cartridge on the tray in Example 1.

When the cartridge B is moved along the supporting surface 18*a* in the direction indicated by the arrow F by a certain extent or more, the bottom surface 20*e* of the position-restricted portion 20*b* comes out of contact with the supporting surface 18*a* and comes into contact with an inclined surface 18*g* as illustrated in FIG. 18. The inclination of the inclined surface 18*g* is larger than the inclination of the supporting surface 18*a*, and is an inclination which allows the position-restricted portion 20*b* to slide downward with respect to the inclined surface 18*g* under the weight of the cartridge B when the bottom surface 20*e* comes into contact therewith. Therefore, in the state illustrated in FIG. 18, the cartridge B moves in a direction indicated by an arrow G along the inclined surface 18*g*. Since there is a step between the inclined surface 18*g* and the position restricting portion 18*b*, the cartridge B moves in a direction E under its own weight after the bottom surface 20*e* and the inclined surface 18*g* have come out of contact with each other. After the movement in the direction E, the position-restricted portion 20*b* of the cartridge B is positioned at the position restricting portion 18*b*, and the supported surface 20*a* is supported by the supporting surface 18*a*, so that mounting of the cartridge B on the tray 18 is completed as illustrated in FIG. 1.

When mounting the cartridge B on the tray 18, the user is allowed to mount the cartridge B on the tray 18 smoothly owing to the provision of the supporting surface 18*a* and the inclined surface 18*g*. In other words, the supporting surface 18*a* and the inclined surface 18*g* are inclined surface extending downward in the direction of mounting of the cartridge B on the tray 18. The user is allowed to mount the cartridge B on the tray 18 by utilizing the weight of the cartridge B.

Figure 1:
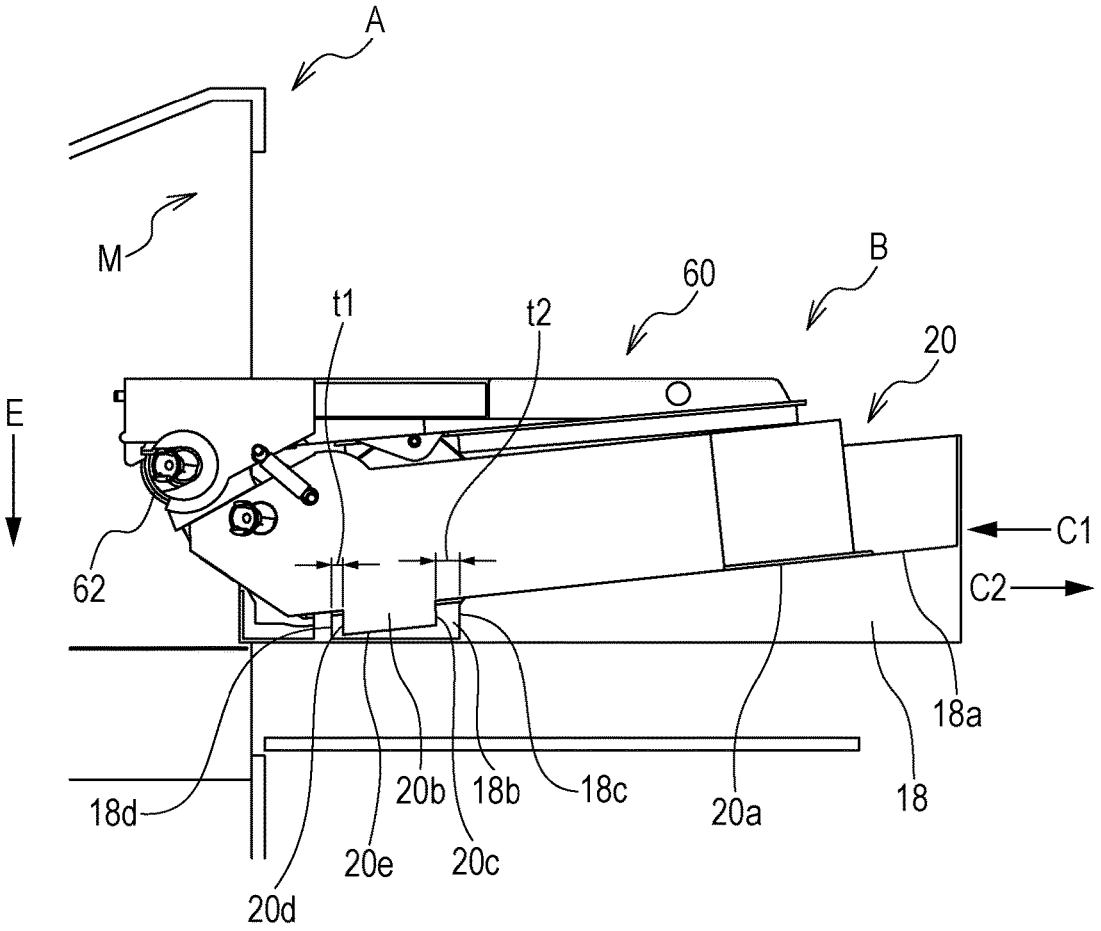
FIG. 1 is a cross-sectional view of a main body of the image forming apparatus of an electrophotographic image forming apparatus according to Example 1 illustrating a state when a process cartridge is mounted on a tray in a state in which an opening and closing door of the main body of the electrophotographic image forming apparatus is opened.
Figure 6:
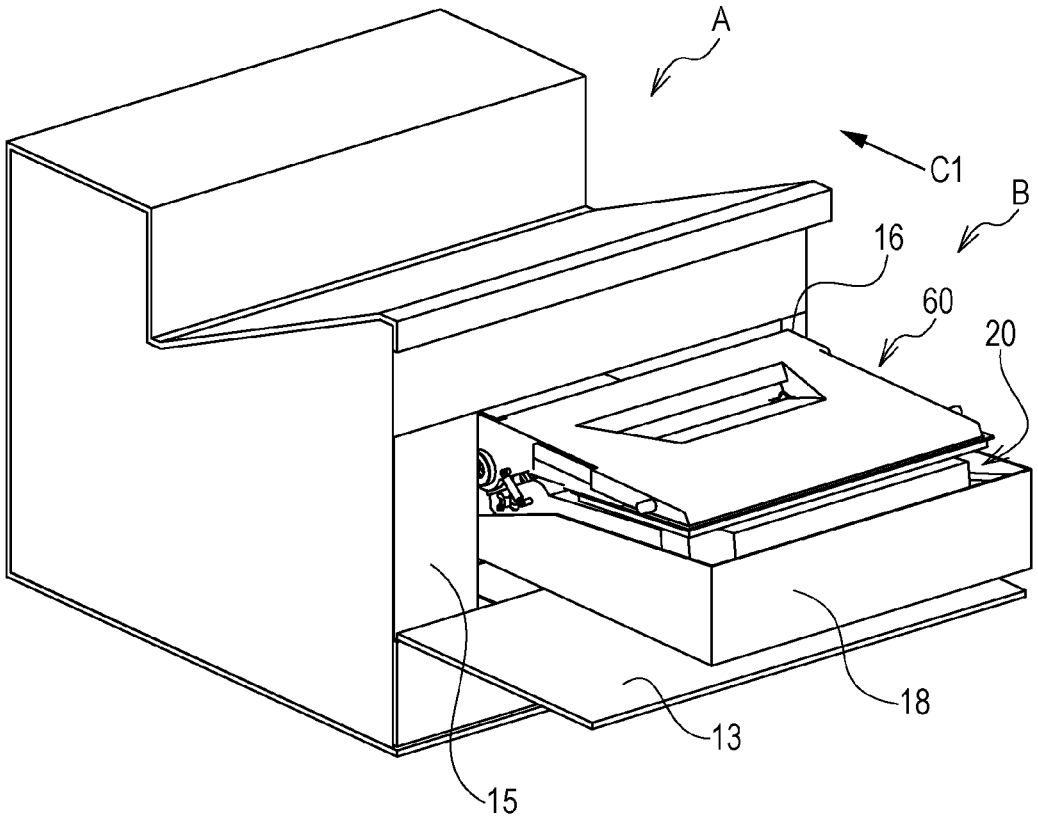
FIG. 6 is a perspective view of the main body of the electrophotographic image forming apparatus in Example 1 in the state in which the opening and closing door thereof is opened and the tray is pulled out.

This example has a configuration in which when the cartridge B is mounted on the tray 18, part (distal end side) of the cartridge B enters the interior of the main body A (see FIG. 6 and FIG. 1). The distal end portion of the cartridge B can be entered in the interior of the main body A and hence can be mounted easily as long as the cartridge B can be mounted on the tray 18 obliquely downward (in the direction indicated by the arrow F) along the supporting surface 18*a* and the inclined surface 18*g*.

In this configuration, the position-restricted portion 20*b*, which corresponds to a projecting portion, is provided on the cartridge B, and the position restricting portion 18*b*, which corresponds to a notched portion, is provided on the main body A. The cartridge B moves in a direction indicated by the arrow F in FIG. 17 with respect to the tray 18 in a state in which the bottom surface 20*e* of the position-restricted portion 20*b* is in contact with the supporting surface 18*a* and moves in the direction indicated by the arrow G in FIG. 18 in a state in which the bottom surface 20*e* of the position-restricted portion 20*b* is in contact with the inclined surface 18*g*. Finally, the cartridge B moves in a direction indicated by an arrow E in FIG. 18 under its own weight and a mounted state in which the cartridge B is restricted in position with respect to the tray 18 is achieved.

In other words, the supporting surface 18*a* and the inclined surface 18*g* not only guide mounting of the cartridge, but also guide the position-restricted portion 20*b* to the position restricting portion 18*b* as a guide (supporting-member-side guide portion). Accordingly, mounting of the cartridge B on the tray 18 and positional restriction of the cartridge B by the position restricting portion 18*b* and the position-restricted portion 20*b* are smoothly achieved.

The user does not have to lift the cartridge B in the course of mounting the cartridge B on the tray 18. In contrast to this example, a configuration in which the position-restricted portion 20*b* is in the form of a notch and the position restricting portion 18*b* is in the form of a projecting portion is also applicable. In this case, however, since the position restricting portion 18*b*, which is a projecting portion, exists in the direction of mounting of the position-restricted portion 20*b*, the user needs to lift the cartridge B when mounting the cartridge B.

Therefore, in the configuration of this example, the user is allowed to mount the cartridge B more smoothly without necessity of lifting the cartridge B for mounting compared with the case where the projecting shape and the notched portion of the position-restricted portion 20*b* and the position restricting portion 18*b* are provided vice versa.

The tray 18 is configured to have a reduced pulling-out amount from the main body A within a range which does not affect demounting of the cartridge B. Specifically, as illustrated in FIG. 1, the drum 62 of the cartridge B is arranged in the main body A at a cartridge mounting and demounting position. Therefore, in a state in which the tray 18 having the cartridge B mounted thereon is at the cartridge mounting and demounting position, the center of gravity of the image forming apparatus is prevented from significantly deviating from the center of gravity of the main body A, so that the main body A is prevented from falling down.

In contrast, as illustrated in FIG. 1, the cartridge B may be demounted from the tray 18 by moving the cartridge B in a direction indicated by an arrow M in FIG. 1 in a state in which the tray 18 is demounted from the main body A in a direction indicated by an arrow C2 and the tray 18 is arranged in the mounting and demounting position.

Mounting and Demounting of Cartridge to Main Body of the Apparatus

Mounting and demounting of the cartridge B with respect to the main body A will be described below. As described above, the main body A is provided with the drive-side supporting portion 1 and the drive-side rotation-restricting portion 2 on the drive-side panel 15 as illustrated in FIG. 8, and the non-drive-side supporting portion 40 and the non-drive-side side rotation-restricting portion 41 are provided on the non-drive-side panel 16 as illustrated in FIG. 9. Since these members function the same on both sides, only a configuration on the drive-side will be described below.

FIG. 1 is a drawing illustrating a state in which the cartridge B is mounted on the tray 18. The supporting surface 18*a* of the tray 18 comes into contact with the supported surface 20*a*, and hence a state in which the cartridge B is supported by the tray 18 is achieved.

The position-restricted portion 20*b* provided on a bottom surface of the developing unit 20 includes a first contacted surface 20*c* and a second contacted surface 20*d*. When the cartridge B is mounted on the tray 18, a gap t1 exists between the first contact surface 18*c* and the first contacted surface 20*c*, and a gap t2 exists between the second contact surface 18*d* and the second contacted surface 20*d*. Therefore, the cartridge B is movable in the direction indicated by the arrow C1 by an amount corresponding to the gap t1, and is movable in the direction indicated by the arrow C2 by an amount corresponding to the gap t2 with respect to the tray 18.

In other words, the position restricting portion 18*b* engages the position-restricted portion 20*b*, so that a range in which the cartridge B is movable with respect to the tray 18 is restricted within a range of a gap (t1+t2).

Mounting of the cartridge B on the main body A will be described first.

When the tray 18 is pressed in the direction indicated by the arrow C1 in FIG. 1, the gap t2 disappears, the first contact surface 18*c* provided on the tray 18 and the first contacted surface 20*c* come into contact, and the process cartridge B moves in the direction indicated by the arrow C1 in FIG. 1 by a force from the tray 18.

Figure 19:
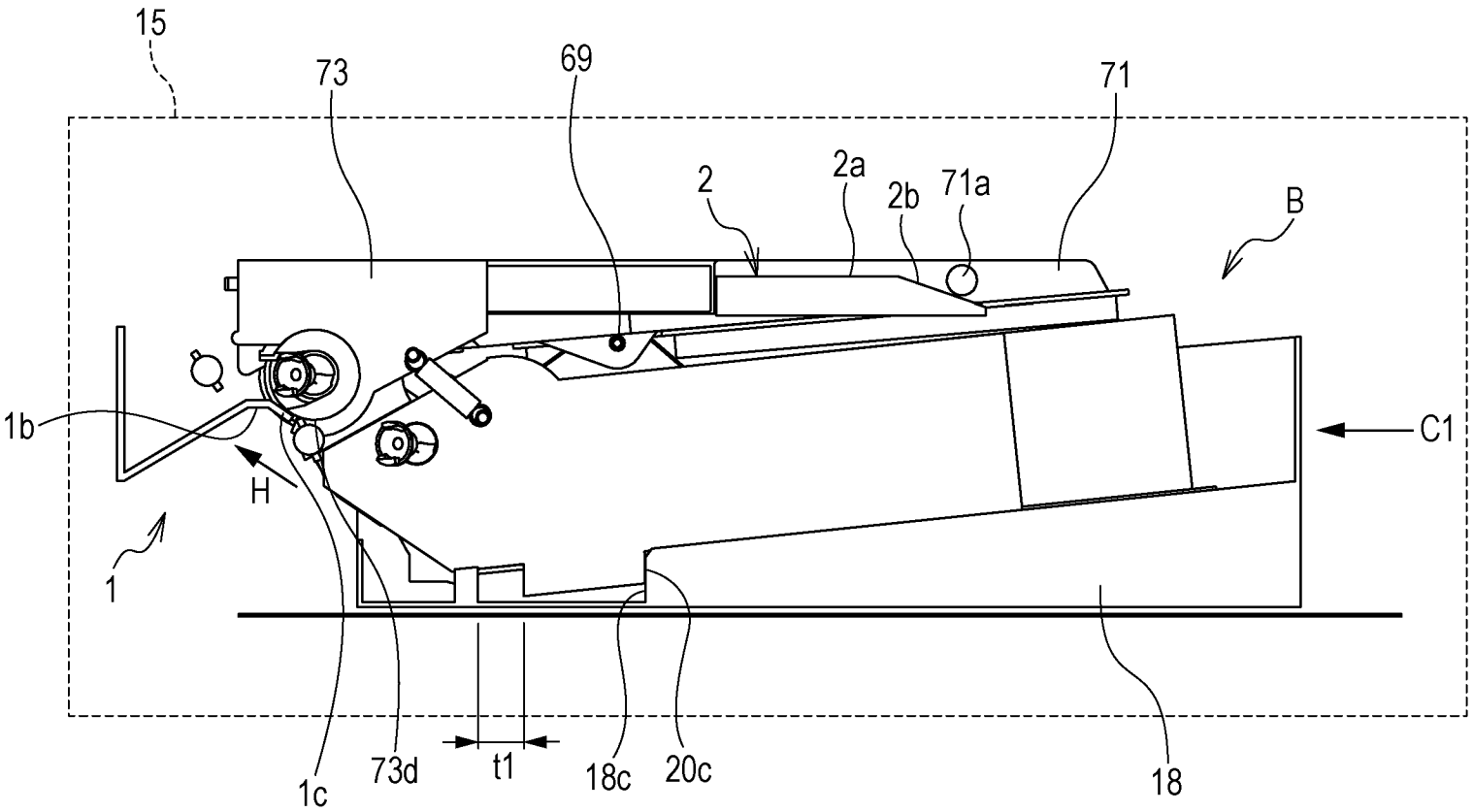
FIG. 19 is a schematic illustration of a main body of the apparatus in a state in which the tray is moved from a mounting and demounting position to an image forming position in a state in which the process cartridge in Example 1 is mounted on the tray.

As illustrated in FIG. 19, a supported portion 73*d* of the drum bearing 73 and the drive-side boss 71*a* of the cleaning frame 71 come into contact with a guide surface 1*c* and a guide portion 2*b* and a guide portion 2*b* provided on the drive-side supporting portion 1 and the drive-side rotation-restricting portion 2. The guide surface 1*c* and /the guide portion 2*b* are surfaces substantially parallel to each other and are inclined with respect to the direction indicated by an arrow C1, so that the cartridge B can be guided in a direction indicated by an arrow H.

Since the first contact surface 18*c* and the first contacted surface 20*c* are in contact with each other, if the tray 18 is moved in the direction indicated by the arrow C1 in FIG. 19, the tray 18 moves in the direction C1. At this time, the supported portion 73*d* and the drive-side boss 71*a* are guided by the guide surface 1*c* and the guide portion 2*b*, the cartridge B is moved relatively to the tray 18 in the direction indicated by the arrow H. As illustrated in FIG. 19, the direction indicated by the arrow H is a vector having at least a component of the direction indicated by the arrow C1. Therefore, the fact that the cartridge B moves in the direction indicated by the arrow H means that the cartridge B moves at least in the direction indicated by the arrow C1.

At this time, the position-restricted portion 20*b* engages the position restricting portion 18*b*, and the gap t1+t2 is provided between the position-restricted portion 20*b* and the position restricting portion 18*b*, so that no problem occurs in the movement of the cartridge B with respect to the tray 18.

The supported portion 73*d* and the drive-side boss 71*a* provided on the cartridge B come into contact with the guide surface 1*c* and the guide portion 2*b* provided on the main body A substantially simultaneously. In other words, the cartridge B starts to translate from the state of being supported by the tray 18 to the state supported by the main body A.

Figure 20:
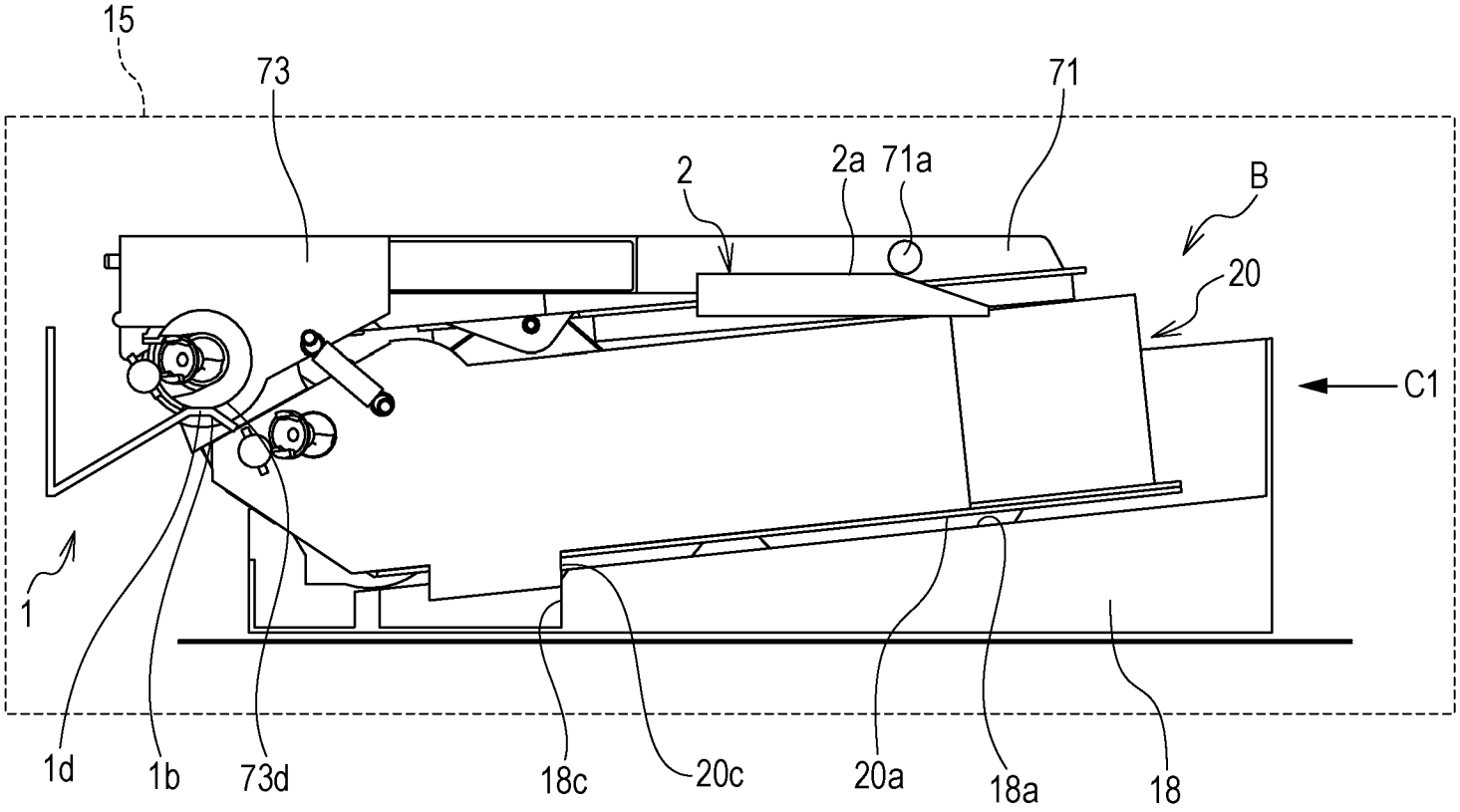
FIG. 20 is a schematic illustration of the main body of the apparatus when moving the tray from the mounting and demounting position to the image forming position in the state in which the process cartridge is mounted on the tray in Example 1.

When the tray 18 is moved further in the direction indicated by an arrow C1, the supported portion 73*d* of the drum bearing 73 and the drive-side boss 71*a* of the cleaning frame 71 are supported by the guide surface 1*d* and the rotation restricting surface 2*a* provided on the drive-side supporting portion 1 and the drive-side rotation-restricting portion 2 as illustrated in FIG. 20.

At this time, the supported surface 20*a* provided on the developing unit 20 comes out of contact with the supporting surface 18*a*, and the process cartridge B is supported by a supporting surface 1*d* of the drive-side supporting portion 1 and the rotation restricting surface 2*a* of the drive-side rotation-restricting portion 2.

In contrast, since the first contact surface 18*c* and the first contacted surface 20*c* are maintained in a contacted state, if the user moves the tray 18 in a direction C1 in FIG. 20, the process cartridge B also moves in the direction indicated by the arrow C1 which is parallel to the supporting surface 1*d* and the rotation restricting surface 2*a*.

Figure 21:
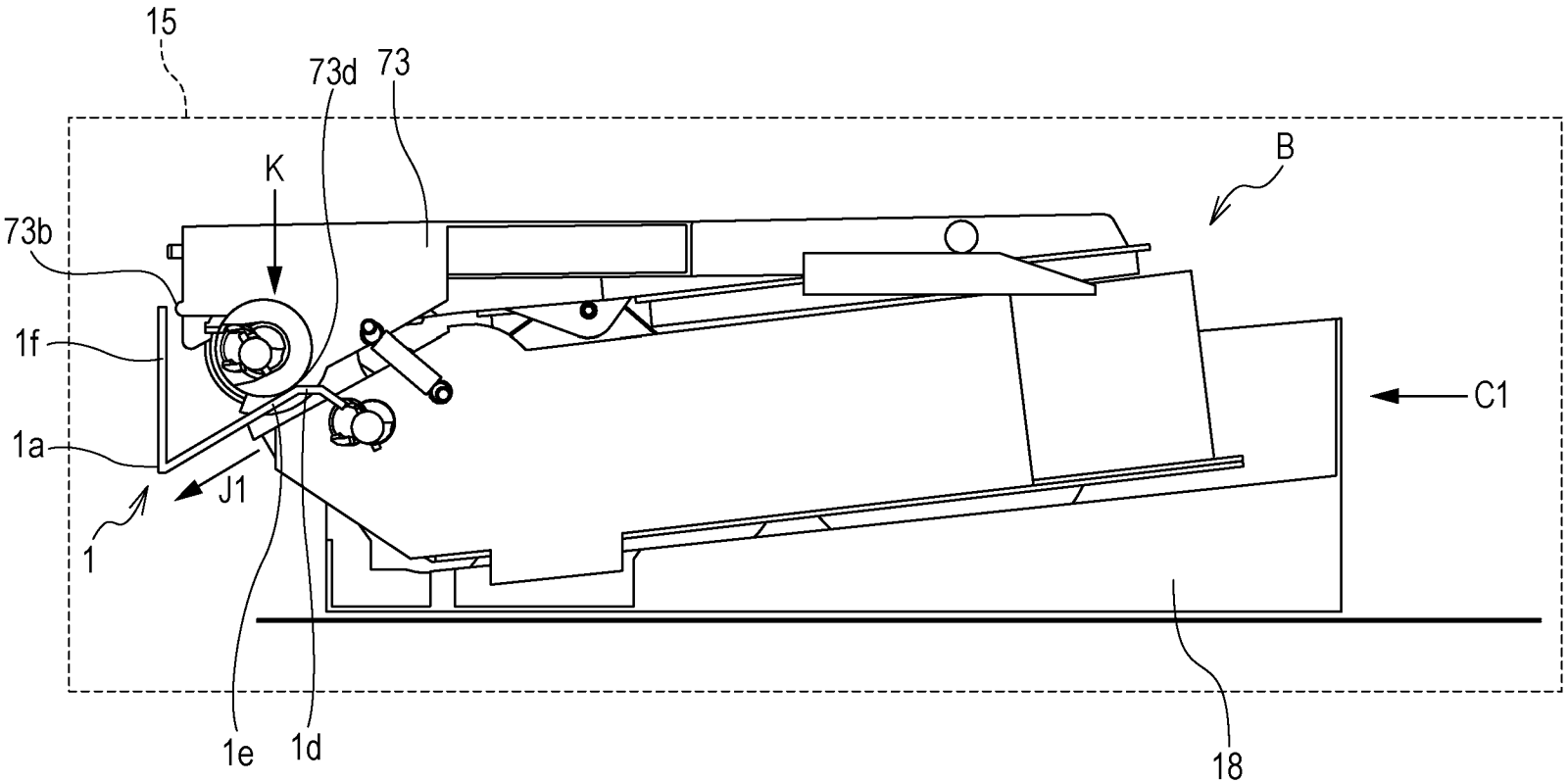
FIG. 21 is a schematic illustration of the main body of the apparatus when moving the tray from the mounting and demounting position to the image forming position in the state in which the process cartridge is mounted on the tray in Example 1.
Figure 22:
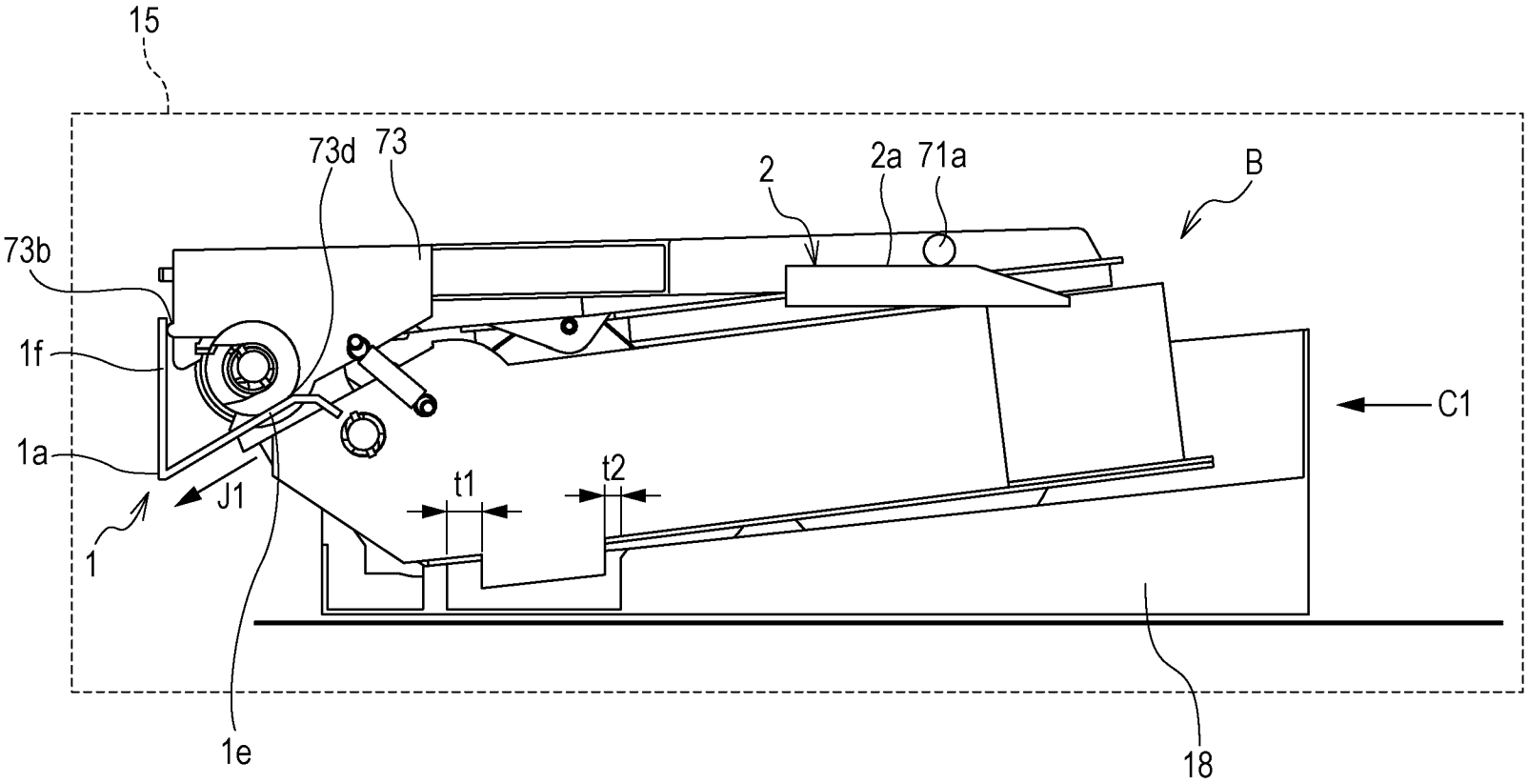
FIG. 22 is a schematic illustration of the main body of the apparatus when the tray is at the image forming position in the state in which the process cartridge is mounted on the tray in Example 1.

As illustrated in FIG. 21, the supported portion 73*d* of the drum bearing 73 is supported by the supporting surface 1*e* provided on the drive-side supporting portion 1. In this state, a spring, which is not illustrated, disposed on the main body A biases the supported portion 73*d* of the drum bearing 73 of the cartridge B in a direction indicated by an arrow K. Since the supporting surface 1*e* has an inclined surface shape which is inclined downward with respect to the direction C1, the process cartridge B moves in a direction indicated by an arrow J1 in FIG. 21 along the supporting surface 1*e* under its own weight and by a biasing force in the direction indicated by the arrow K. When the process cartridge B is moved by a predetermined amount, the supported portion 73*b* of the drum bearing 73 comes into contact with the supporting surface 1*f* of the supporting portion 1*a*, the supported portion 73*d* comes into contact with the supporting surface 1*e* of the supporting portion 1*a*, and the drive-side boss 71*a* comes into contact with the rotation restricting surface 2*a* as illustrated in FIG. 22. In this state, the process cartridge B is positioned within the main body A, and mounting on the main body A is completed. As illustrated in FIG. 21, the direction indicated by the arrow J1 is a vector having at least a component of the direction indicated by the arrow C1. Therefore, the fact that the cartridge B moves in the direction indicated by the arrow J1 means that the cartridge B moves at least in the direction indicated by the arrow C1.

In association with a series of processes described above, the cartridge B is translated from the state supported by the tray 18 to the state supported by the main body A. In other words, in association with the movement of the tray 18 from the mounting and demounting position to the image forming position, the cartridge B can be mounted on the main body A. The user is allowed to mount the cartridge B on the main body A in a state in which the posture of the cartridge B is stabilized by the tray 18.

The tray 18 does not have a configuration in which the cartridge B is completely positioned in the directions C1 and C2 in FIG. 1.

When the tray 18 is at the image forming position, the cartridge B is directly positioned with respect to the main body A, but not with respect to the tray 18.

Figure 25:
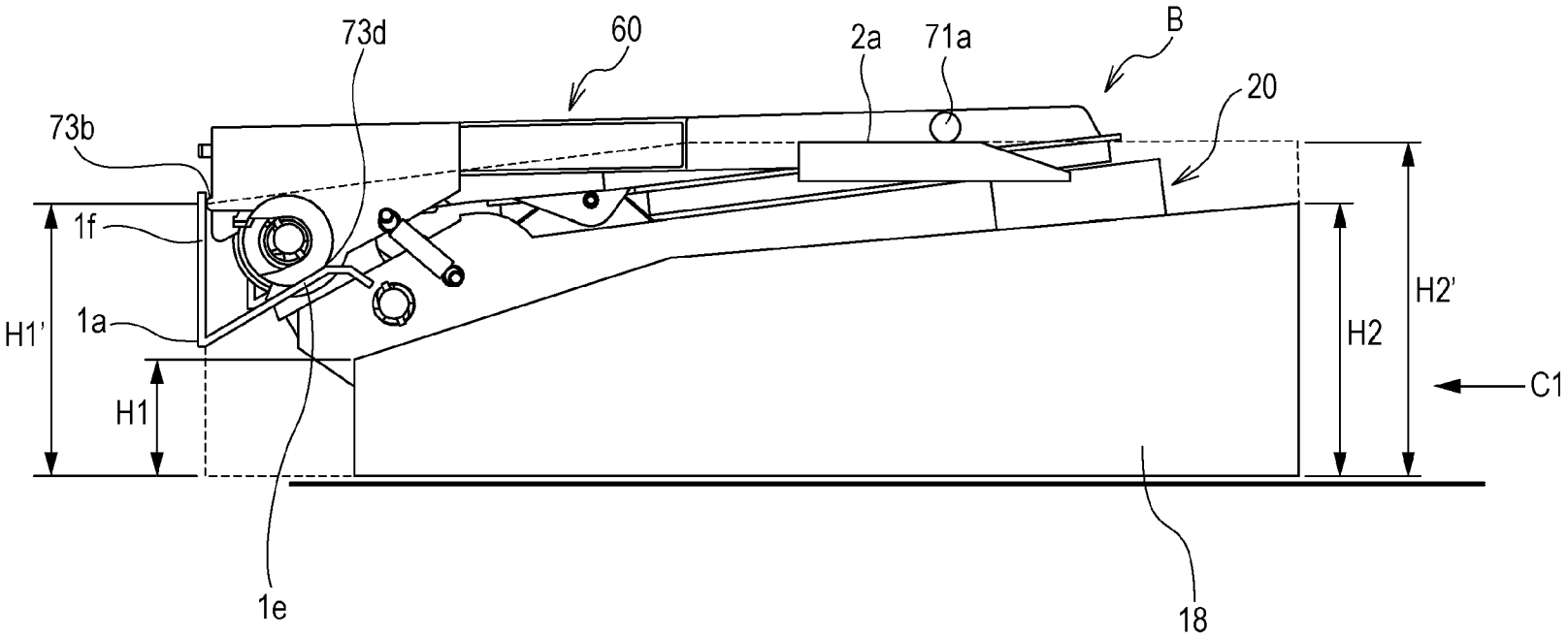
FIG. 25 is a schematic illustration of the main body of the apparatus when the tray is at the image forming position in the state in which the process cartridge is mounted on the tray in Example 1.

As illustrated in FIG. 25, in this configuration, the supported portion 73*b*, the supported portion 73*d*, and the drive-side boss 71*a* of the cleaning unit 60 of the cartridge B come into contact with the supporting portion 1*a* of the main body A and the rotation restricting surface 2*a* of the drive-side rotation-restricting portion 2, and hence the cartridge B is positioned with respect to the main body A.

Reference signs H1 and H2 are heights of the tray 18 on a downstream side and an upstream side in the direction of tray insertion C1 in this configuration. Reference sign H1' is a height from a bottom surface of the tray 18 to a higher contact point between a contact point of the supported portion 73*b* with respect to the supporting portion 1*a* of the main body A and a contact point of the supported portion 73*d* with respect to the supporting portion la of the main body A. Reference sign H2' is a height of a contact point between the drive-side boss 71*a* and the rotation restricting surface 2*a* from the bottom surface of the tray 18.

When an attempt is made to provide the tray 18 with a configuration for positioning the cartridge B, the tray 18 needs to have a configuration of supporting the supported portions 73*b*, 73*d*, and 71*a*. In this case, reference numeral H1 needs to be set to the same height as H1' or larger, and the height of H2 needs to be set to the same height as H2' or larger.

In contrast, in this configuration, the main body A, instead of the tray 18, is provided with the configuration for positioning the cartridge B, and hence setting the height H1 to be equal to or larger than the height H1' and the height H2 to be larger than the height H2' is not necessary. Therefore, the height H1 is smaller than H1', and the height H2 is smaller than H2'.

Therefore, the height of the tray 18 may be relatively lower than the cartridge B, and hence the space of the tray 18 may be effectively utilized, so that a reduction in the size of the main body A is enabled.

In particular, in this example, the position of an upper end (the position having a height H2) of the tray 18 is lower than the contact position between the rotation restricted surface 71*a* and the rotation restricting surface 2*a* as illustrated in FIG. 25.

Figure 23:
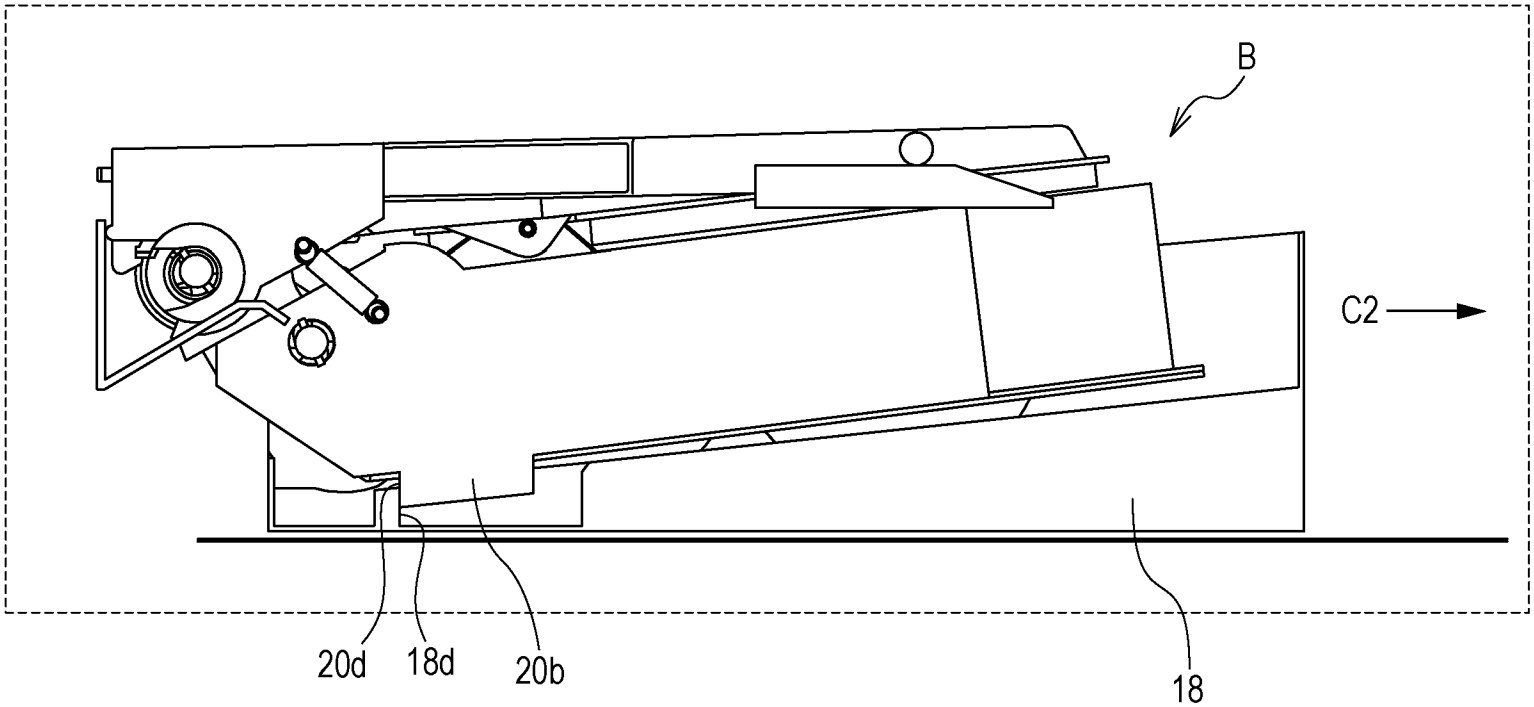
FIG. 23 is a schematic illustration of the main body of the apparatus when moving the tray from the image forming position to the mounting and demounting position in the state in which the process cartridge is mounted on the tray in Example 1.
Figure 24:
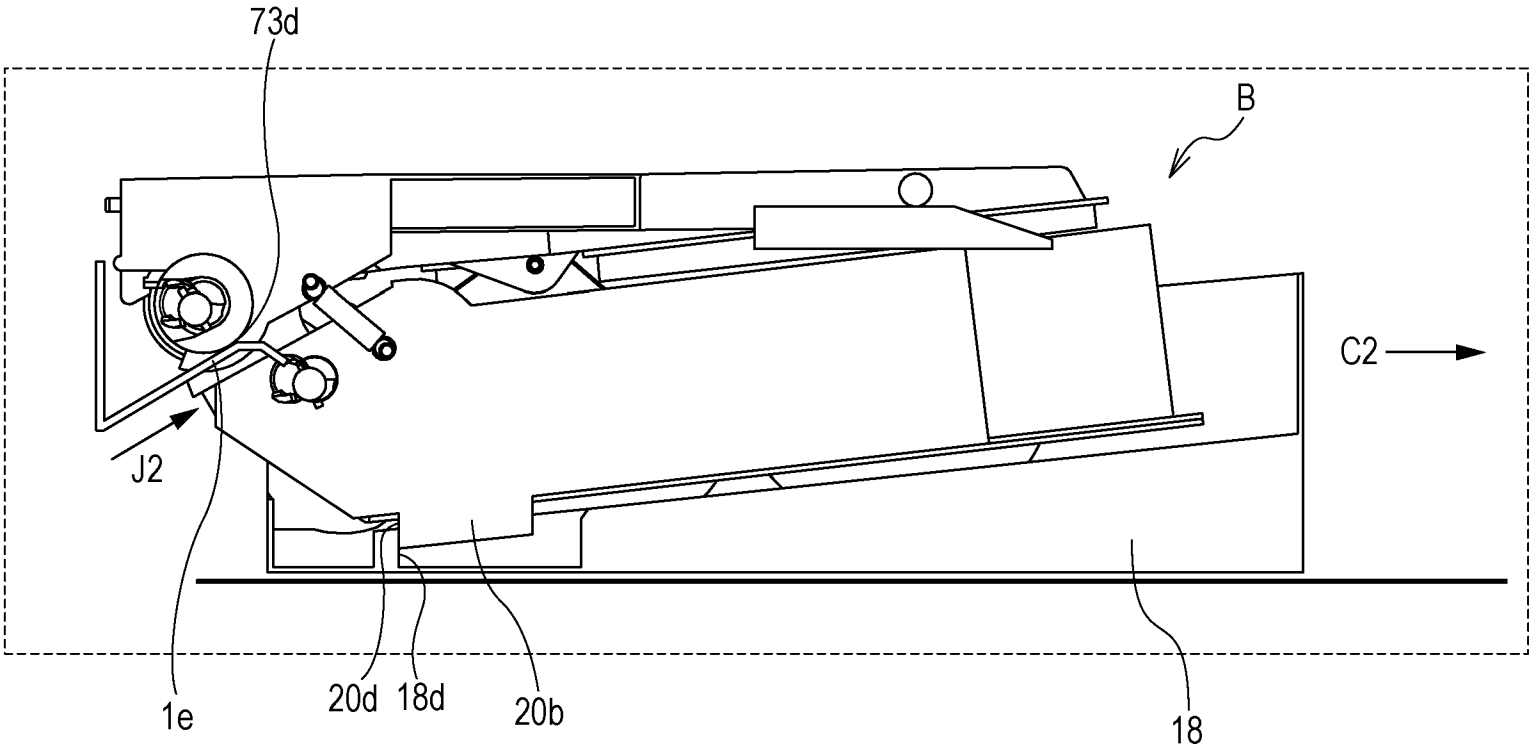
FIG. 24 is a schematic illustration of the main body of the apparatus when moving the tray from the image forming position to the mounting and demounting position in a state in which the process cartridge is mounted on the tray in Example 1.

Subsequently, demounting of the cartridge B from the main body A will now be described. In a state in which mounting of the process cartridge B on the main body A is completed as illustrated in FIG. 22, gaps t1 and t2 are provided between the first contact surface 18*c* and the first contacted surface 20*c* and between the second contact surface 18*d* and the second contacted surface 20*d*. In this state, the cartridge B is in a state of being positioned by the supporting portion 1*a* and the rotation restricting surface 2*a*. Therefore, as illustrated in FIG. 23, when the tray 18 is moved in the direction indicated by an arrow C2 in FIG. 23, only the tray 18 is moved. In other words, the cartridge B is moved relatively in the opposite direction to the direction indicated by the arrow C2 with respect to the tray 18. Consequently, the gap t1 between the position-restricted portion 20*b* and the position restricting portion 18*b* (see FIG. 23) disappears and the second contact surface 18*d* comes into contact with the second contacted surface 20*d*. In addition, as illustrated in FIG. 24, the process cartridge B moves ongoingly in a direction indicated by an arrow J2 in FIG. 24 by the supporting portion 73*d* guided by the supporting surface 1*e* in association with the movement of the tray 18 in the direction C2. As illustrated in FIG. 21, the direction indicated by the arrow J2 is a vector having at least a component of the direction indicated by the arrow C2. Therefore, the fact that the cartridge B moves in the direction indicated by the arrow J2 means that the cartridge B moves at least in the direction indicated by the arrow C2.

When the tray 18 is moved in the direction indicated by the arrow C2 in FIG. 23 continuously, the cartridge B is translated from being supported by the drive-side supporting portion 1 and the drive-side rotation-restricting portion 2 to a state of being supported by the supporting surface 18*a* provided on the tray 18 in contrast to the case of being mounted.

In other words, the cartridge B is translated from the state of being supported by the main body A to the state of being supported by the tray 18 in association with the movement of the tray 18.

In addition, by moving the tray 18 further in the direction indicated by the arrow C2 in FIG. 23, the tray 18 is allowed to return to the cartridge mounting and demounting position illustrated in FIG. 1. In this state, the user grips the grip, which is not illustrated, from the mounting and demounting position and moves the cartridge B in the direction M, so that demounting of the cartridge B from the main body A is completed.

In conclusion, summary of the configuration of the example described thus far is as follows. A position-restricted portion 20*b* is provided on the developing unit 20 of the cartridge B as a mechanism for limiting the movement of the cartridge B with respect to the tray 18 within a certain range. The tray 18 is provided with position restricting portions 18*b* and 18*f* configured to engage the position-restricted portions 20*b* and 20*f*. Accordingly, the movement of the cartridge B with respect to the tray 18 is limited to the certain range, so that the cartridge B can be mounted and demounted with respect to the main body A only by moving the tray 18.

Here, the developing unit 20 is a unit positioned below the cleaning unit 60 in a state in which the cartridge is mounted on the tray 18. Therefore, the position-restricted portions 20*b* and 20*f* may be arranged at low positions in the cartridge B. The positions where the position restricting portions 18*b* and 18*f* are to be arranged in the tray 18 are also low. Consequently, the height of the tray 18 may be reduced as a whole, and the height of the main body A on which the tray 18 is mounted, that is, the height of the image forming apparatus is also reduced. A reduction in the size of the image forming apparatus is achieved.

The position-restricted portion 20*b* and the movement restricting portion 18*b* engage each other at a certain gap (t1+t2) interposed therebetween (see FIG. 1). Therefore, the movement of the cartridge B with respect to the tray 18 is limited, but a movement in a certain range, that is, an amount corresponding to the gap (t1+t2) is allowed. Therefore, when the tray 18 is moved to the image forming position (FIG. 2 and FIG. 5), the cartridge B moves the position-restricted portion 20*b* with respect to the movement restricting portion 18*b* to move relatively with respect to the tray 18. Accordingly, the cartridge B is smoothly translated from the state of being supported by the tray 18 to the state of being supported by the main body A.

The cartridge B is positioned with high degree of accuracy directly by the main body A by being supported by the main body A.

In the same manner, when the tray 18 moves toward the mounting and demounting position (FIG. 1 and FIG. 6), the cartridge B moves relatively with respect to the tray 18 while moving the position-restricted portion 20*b* with respect to the movement restricting portion 18*b*. Consequently, the cartridge B is smoothly translated from the state of being supported by the main body A to the state of being supported by the tray 18.

As described thus far, according to the example, since the position restricting portion 18*b* for the cartridge B is provided on the tray 18 and the positioning portion for the cartridge B is provided on the main body A, the height of the tray 18 can be reduced, and hence a reduction in the size of the tray 18 and the main body A is enabled.

EXAMPLE 2

Next, a mode of Example 2 of this disclosure will be described. In Example 2, a portion different from Example 1 described above will be described in detail. The materials and the shapes are the same as those in Example described above unless otherwise described anew. Those parts are denoted by the same reference numerals, and detailed description will be omitted. In Example 2, the number and the positions of position-restricted portions and position restricting portions are modified.

Mounting and Demounting of Cartridge to Tray

Figure 26:
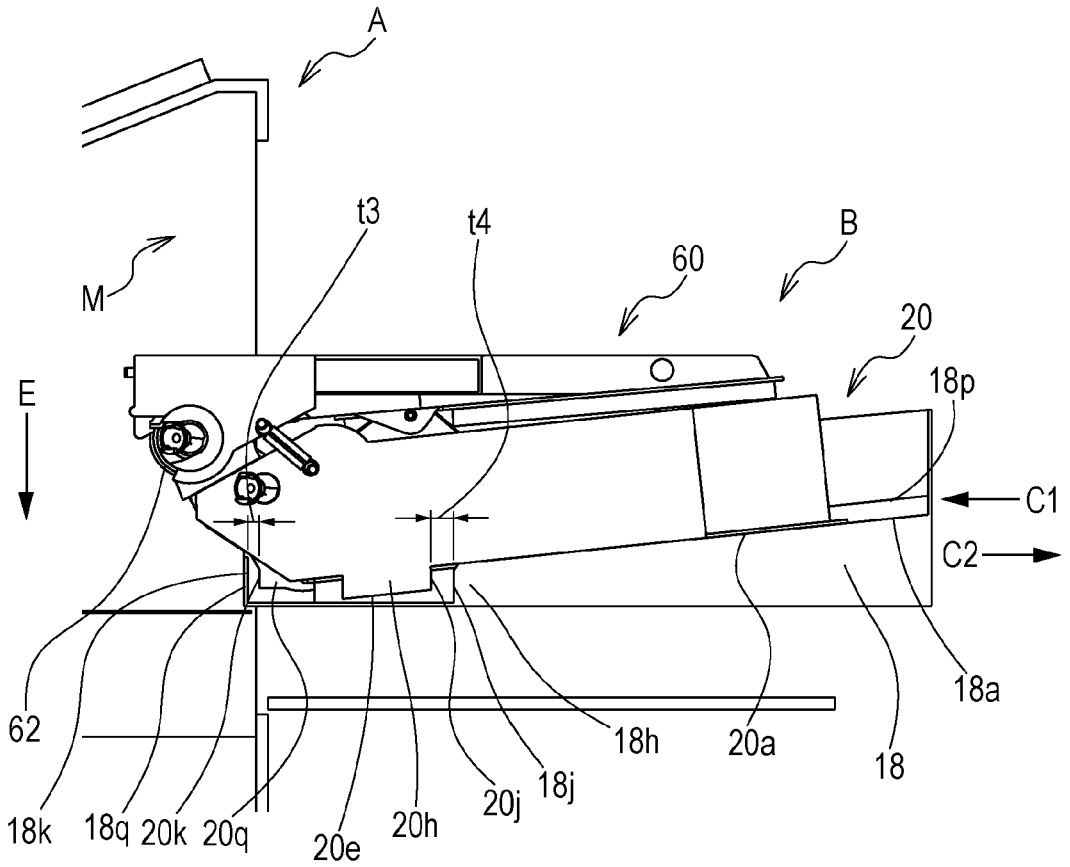
FIG. 26 is a cross-sectional view of a main body of an electrophotographic image forming apparatus in a state in which a process cartridge is mounted on a tray in a state in which the opening and closing door of the main body of the electrophotographic image forming apparatus is opened according to a second embodiment when the process cartridge is mounted on the tray in Example 2.
Figure 27A:
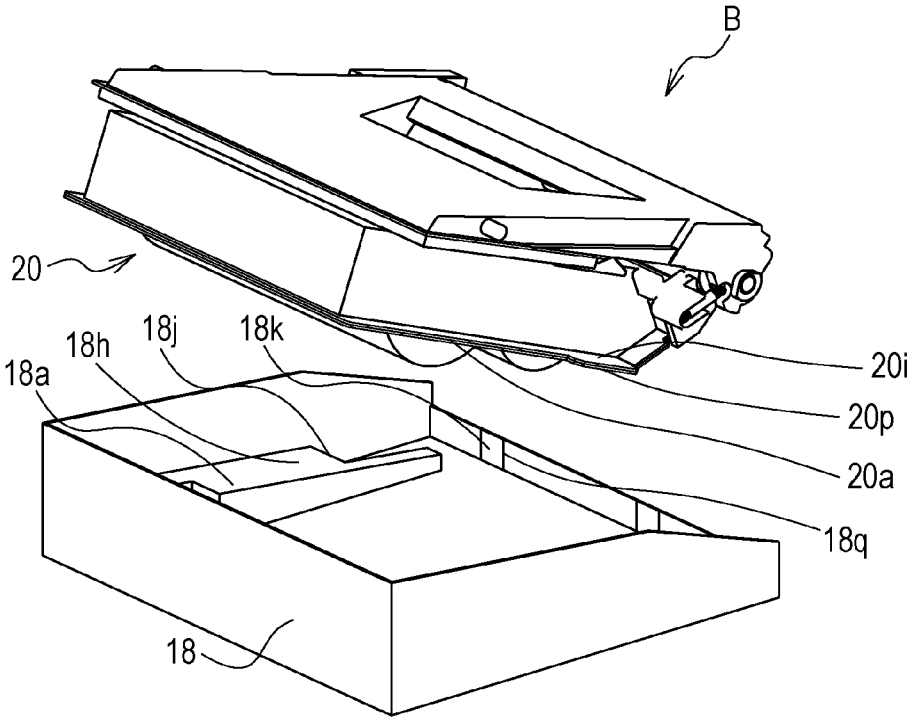
FIGS. 27A and 27B are perspective views illustrating a state of mounting the process cartridge on the tray in Example 2.
Figure 27B:
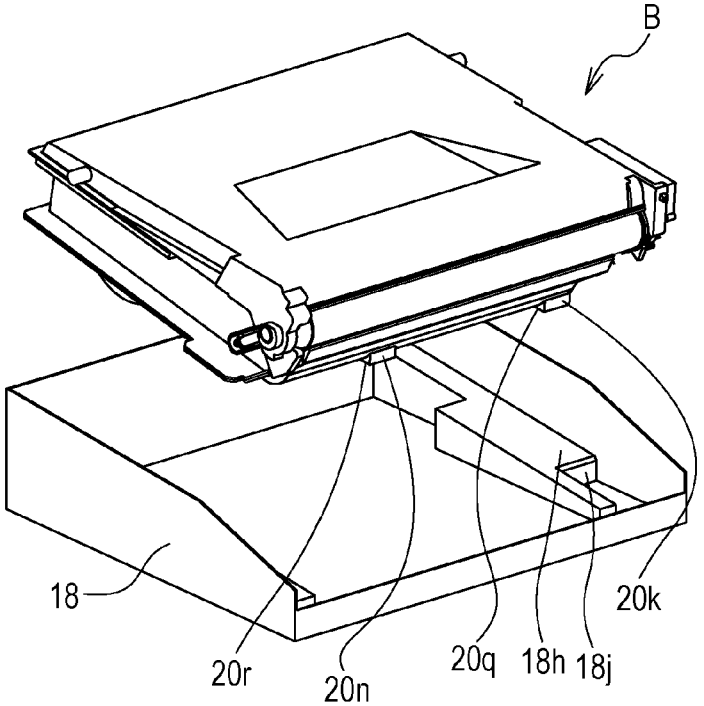
Figure 28A:
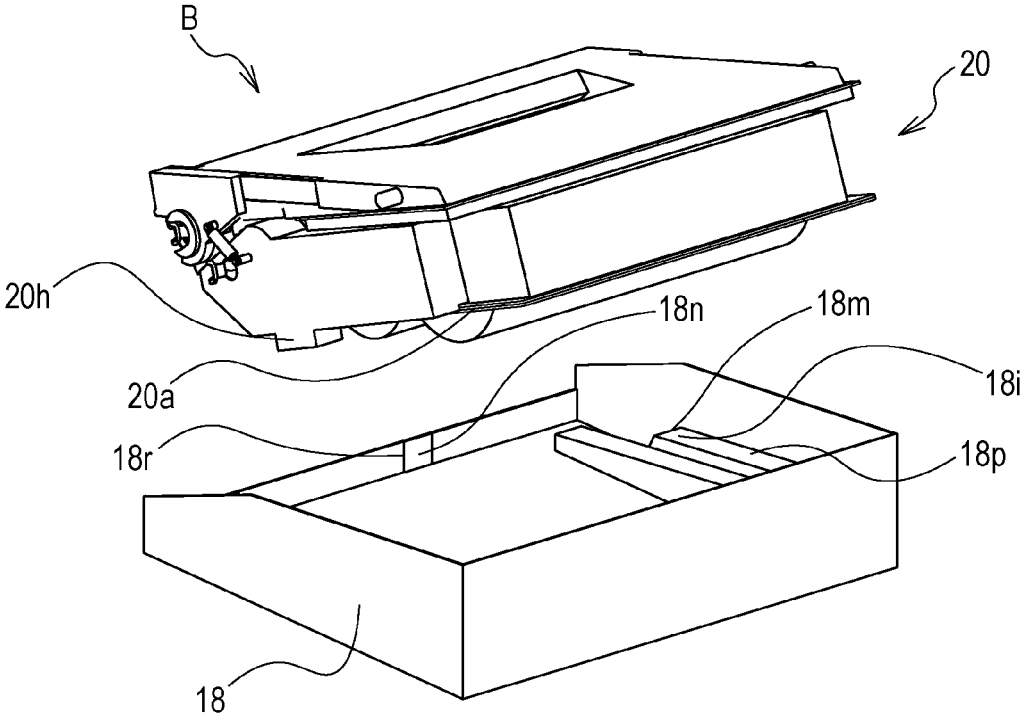
FIGS. 28A and 28B are perspective views illustrating a state of mounting the process cartridge on the tray in Example 2.
Figure 28B:
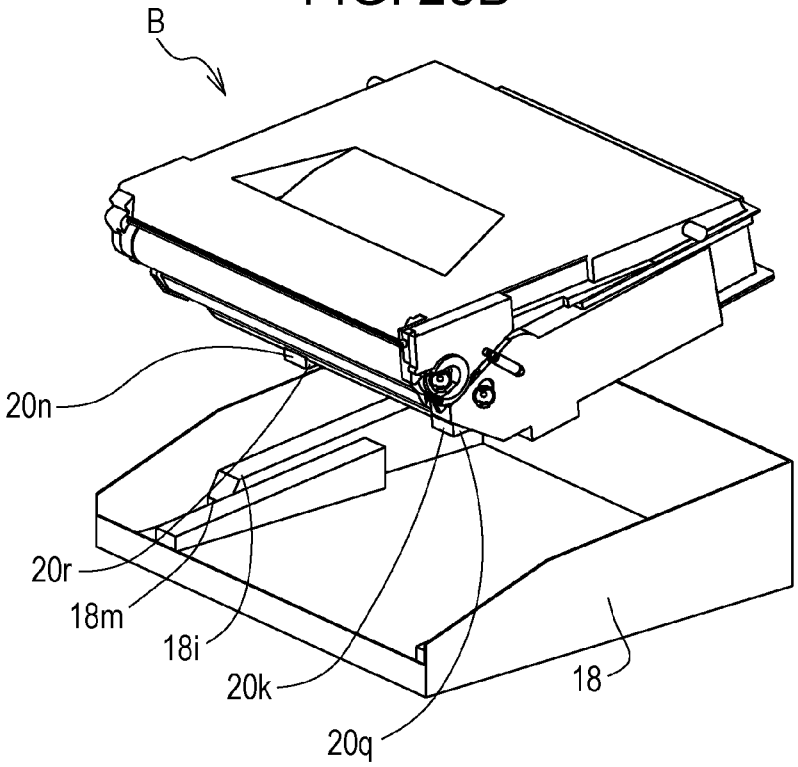
Figure 29:
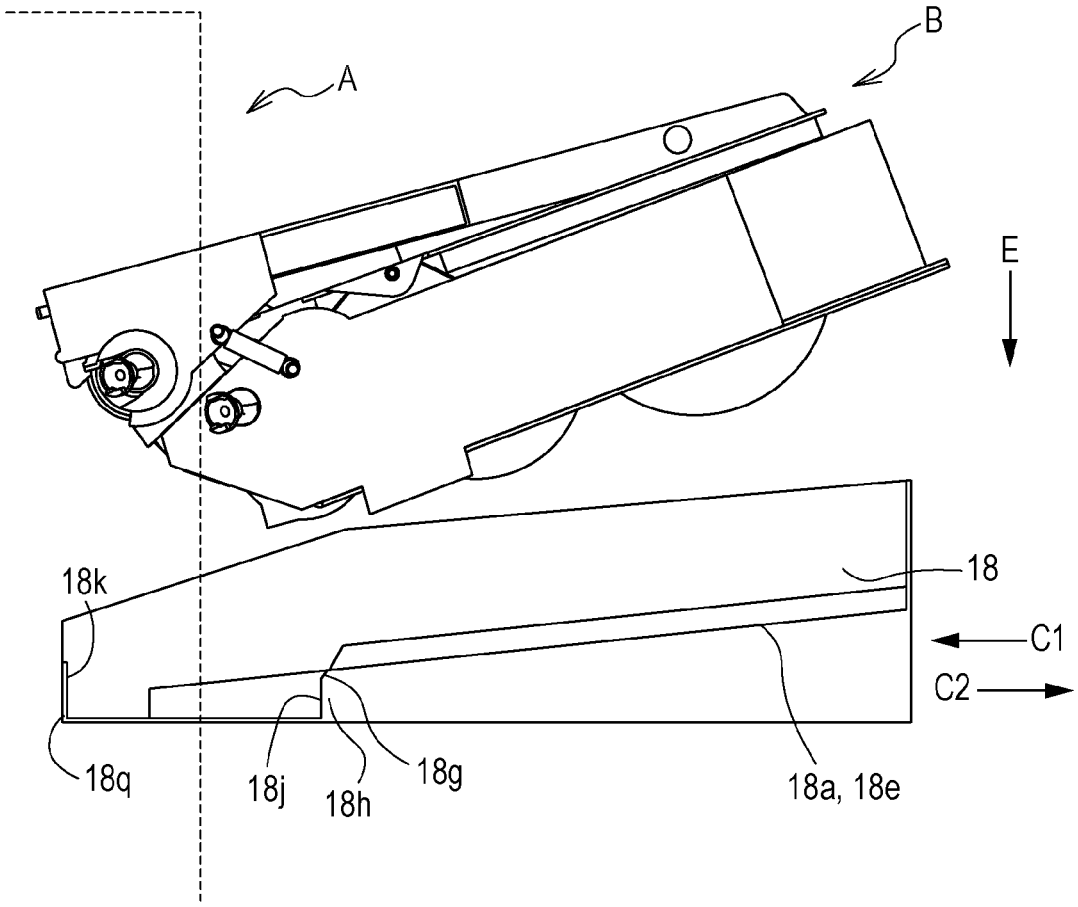
FIG. 29 is a cross-sectional view of the tray in a state of mounting the process cartridge on the tray in Example 2.
Figure 30:
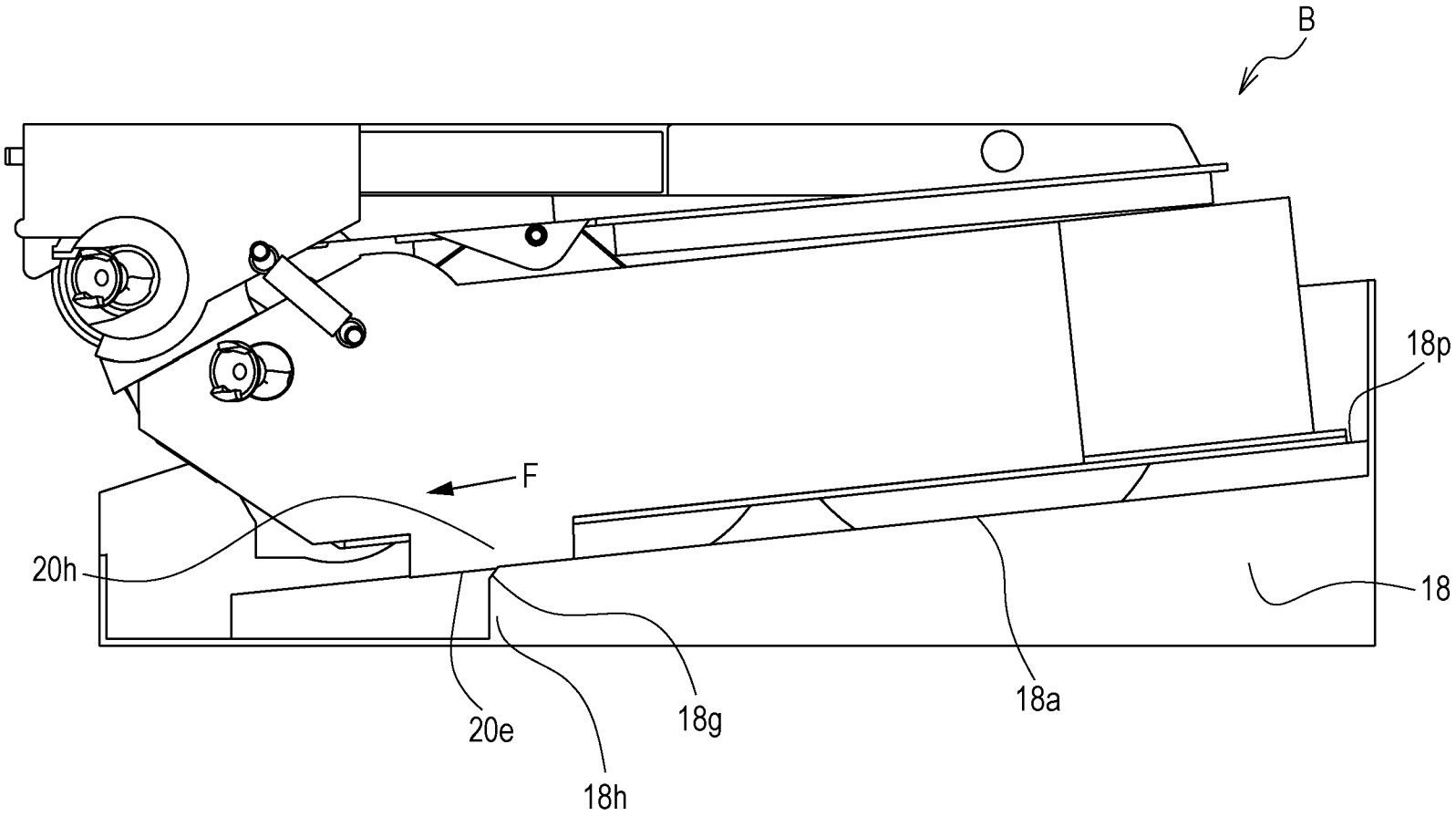
FIG. 30 is a cross-sectional view of the tray in the state of mounting the process cartridge on the tray in Example 2.
Figure 31:
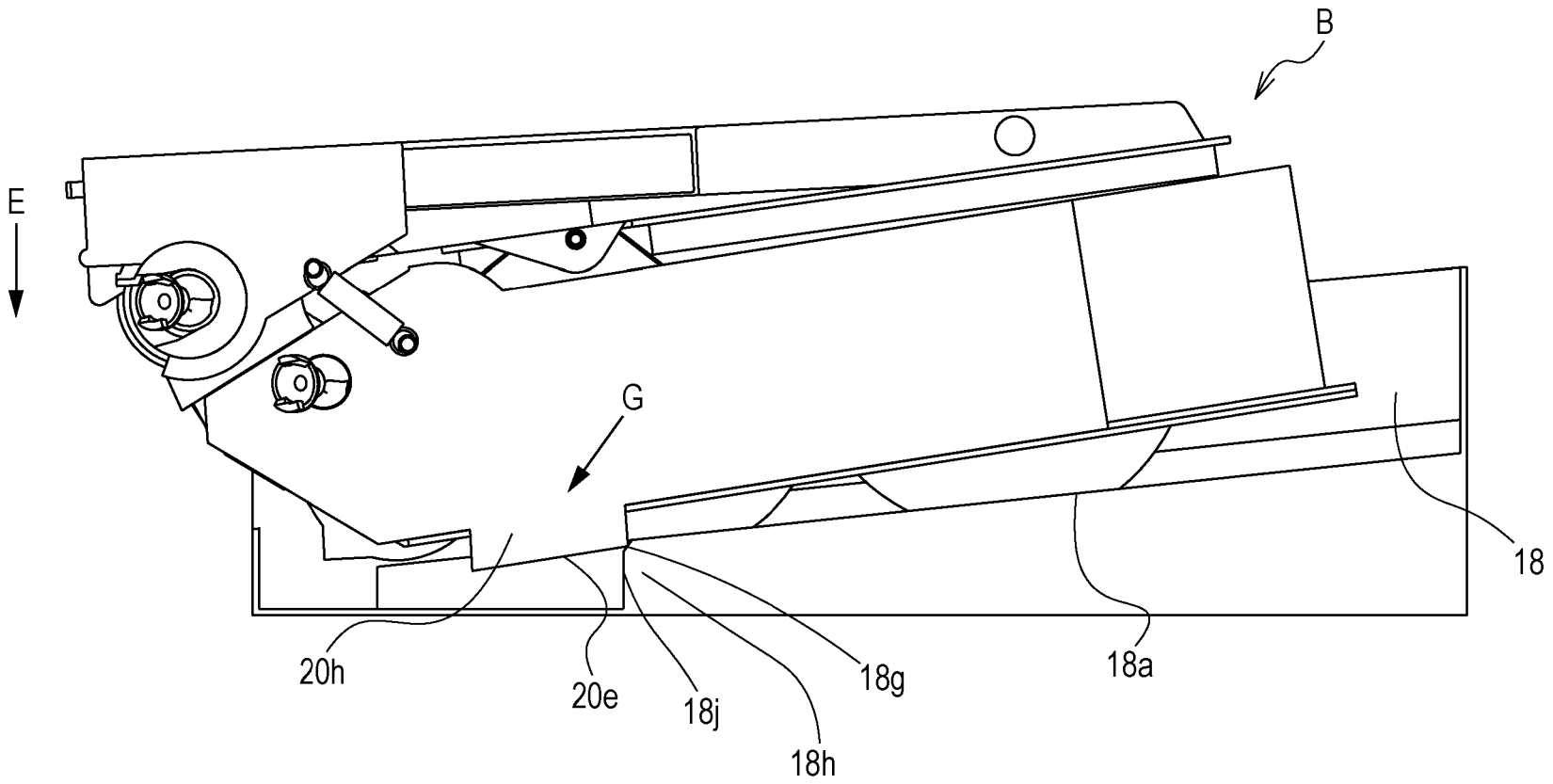
FIG. 31 is a cross-sectional view of the tray in the state of mounting the process cartridge is mounted on the tray in Example 2.

Mounting and demounting of the cartridge B with respect to the tray 18 will be described. FIG. 26 is a schematic drawing illustrating a state in which the cartridge B is mounted on the tray. FIGS. 27A and 27B, and FIGS. 28A and 28B are perspective views illustrating elements of the cartridge B and the tray 18. FIGS. 29, 30, and 31 are schematic illustration of a positional relationship between the cartridge B and the tray 18 at the time of mounting and demounting illustrated in chronological order.

As illustrated in FIGS. 27A and 27B and FIGS. 28A and 28B, the developing unit 20 of the cartridge B includes position-restricted portions 20*h*, 20*i*, 20*q* and 20*r* (which correspond respectively to first, second, third, and fourth position-restricted portions 20*h*, 20*i*, 20*q*, and 20*r*) disposed on a bottom surface thereof. The tray 18 also includes position restricting portions 18*h*, 18*i*, 18*q*, and 18*r* (which correspond respectively to first, second, third, and fourth position restricting portions 18*h*, 18*i*, 18*q*, and 18*r*) disposed thereon. As illustrated in FIG. 26, when the cartridge B is moved in a direction indicated by an arrow C1 by a certain extent in a state in which the cartridge B is mounted on the tray 18, the first position-restricted portion 20*h* and the first position restricting portion 18*h* provided on a drive-side come into contact with each other. In the same manner, when the cartridge B is moved in a direction indicated by an arrow C2 by a certain extent, the third position-restricted portion 20*q* and the third position restricting portion 18*q* come into contact with each other, so that the cartridge B is restricted from moving in the directions indicated by the arrow C1 and C2 with respect to the tray 18. In the same manner, on a non-drive-side as well, the second position-restricted portion 20*i* comes into contact with the second position restricting portion 18*i* and the fourth position-restricted portion 20*r* comes into contact with the fourth position restricting portion 18*r*, so that the cartridge B is restricted from moving in the directions indicated by the arrows C1 and C2 with respect to the tray 18 (not illustrated).

As illustrated in FIG. 26, on the drive-side, the first position restricting portion 18*h* includes a first contact surface 18*j* and the third position restricting portion 18*q* includes a third contact surface 18*k*. The first position-restricted portion 20*h* includes a first contacted surface 20*j* which comes into contact with the first contact surface 18*j*, and the third position-restricted portion 20*q* includes a third contacted surface 20*k* which comes into contact with the third contact surface 18*k*.

In the same manner, on the non-drive-side, the second position restricting portion 18*i* includes a second contact surface 18*m* and the fourth position restricting portion 18*r* includes a fourth contact surface 18*n*. The second position-restricted portion 20*i* includes a second contacted surface 20*m* which comes into contact with the second contact surface 18*m*, and the fourth position-restricted portion 20*r* includes a fourth contacted surface 20*n* which comes into contact with the fourth contact surface 18*n* (not illustrated).

Next, mounting and demounting of the cartridge B with respect to the tray 18 will be described with reference to FIGS. 28A and 28B, FIG. 29, and FIG. 30. FIG. 29 illustrates a state in which the opening and closing door 13 (see FIG. 6) is opened, the tray 18 is drawn out from an image forming position and is at a mounting and demounting position at which the cartridge B can be mounted on and demounted from the tray 18. In FIG. 29, when a user grips a grip, which is not illustrated, the cartridge B is mounted on the tray 18 from a direction indicated by an arrow E in FIG. 29, and the bottom surface 20*e* of the first position-restricted portion 20*h* comes into contact with the supporting surface 18*a* as illustrated in FIG. 30. A bottom surface 20*p* of the second position-restricted portion 20*i* illustrated in FIG. 27A comes into contact with a supporting surface 18*p* illustrated in FIG. 28A. At this time, the supporting surfaces 18*a* and 18*p* are inclined, and the user is allowed to move the cartridge B in a direction indicated by an arrow F in FIG. 30 in a state in which the first position-restricted portion 20*b* is in contact with the supporting surface 18*a* and the second position-restricted portion 20*i* is in contact with the supporting surface 18*p*. In other words, the supporting surfaces 18*a* and 18*p* are guides (supporting-member-side guide portions) configured to come into contact with the first and second position-restricted portions 20*h* and 20*i* to guide the cartridge B to be mounted on the tray 18.

When the cartridge B is moved along the supporting surfaces 18*a* and 18*p* in the direction indicated by the arrow F by a certain extent or more, the bottom surface 20*e* of the first position-restricted portion 20*h* comes out of contact with the supporting surface 18*a* and comes into contact with an inclined surface 18*g* as illustrated in FIG. 31. The inclination of the inclined surface 18*g* is larger than the inclination of the supporting surface 18*a*, and is an inclination which allows the first position-restricted portion 20*h* to slide downward with respect to the inclined surface 18*g* under the weight of the cartridge B when the bottom surface 20*e* comes into contact therewith. Therefore, in the state illustrated in FIG. 31, the cartridge B moves in a direction indicated by an arrow G along the inclined surface 18*g*. After the cartridge B has slipped by a certain extent and thus the bottom surface 20*e* and the inclined surface 18*g* have come out of contact with each other, the cartridge B moves in a direction indicated by an arrow E under its own weight. Consequently, as illustrated in FIG. 26, the first position-restricted portion 20*h* and the third position-restricted portion 20*q* are arranged between the first position restricting portion 18*h* and the third position restricting portion 18*q*. At the same timing, the bottom surface 20*p* of the second position-restricted portion 20*i* is released from being supported by the supporting surface 18*p*, and the second position-restricted portion 20*i* and the fourth position-restricted portion 20*r* are arranged between the second position restricting portion 18*i* and the fourth position restricting portion 18*r* (not illustrated). A state in which the supported surface 20*a* is supported by the supporting surface 18*a*, and hence mounting on the tray 18 is completed.

Mounting and Demounting of Cartridge to Main Body of the Apparatus

FIG. 26 is a drawing illustrating a state in which the cartridge B is mounted on the tray 18 from the drive-side. The first position-restricted portion 20*h* and the second position-restricted portion 20*q* are disposed on a bottom surface of the developing unit 20 as downward projecting portions. The first position-restricted portion 20*h* is provided with the first contacted surface 20*j*, and the third position-restricted portion 20*q* is provided with the third contacted surface 20*k* disposed thereon. When the cartridge B is mounted on the tray 18, a gap t3 exists between the first contact surface 18*j* and the first contacted surface 20*j*, and a gap t4 exists between the second contact surface 18*k* and the second contacted surface 20*k*. Therefore, the cartridge B is movable in the direction indicated by the arrow C1 by an amount corresponding to the gap t3, and is movable in the direction indicated by the arrow C2 by an amount corresponding to the gap t4 with respect to the tray 18. The first and third position restricting portions 18*h* and 18*q* come into contact with the first and third position-restricted portions

20*h* and 20*q*, so that a range in which the cartridge B is movable with respect to the tray 18 is restricted within a range of a gap (t3+t4).

Figure 32:
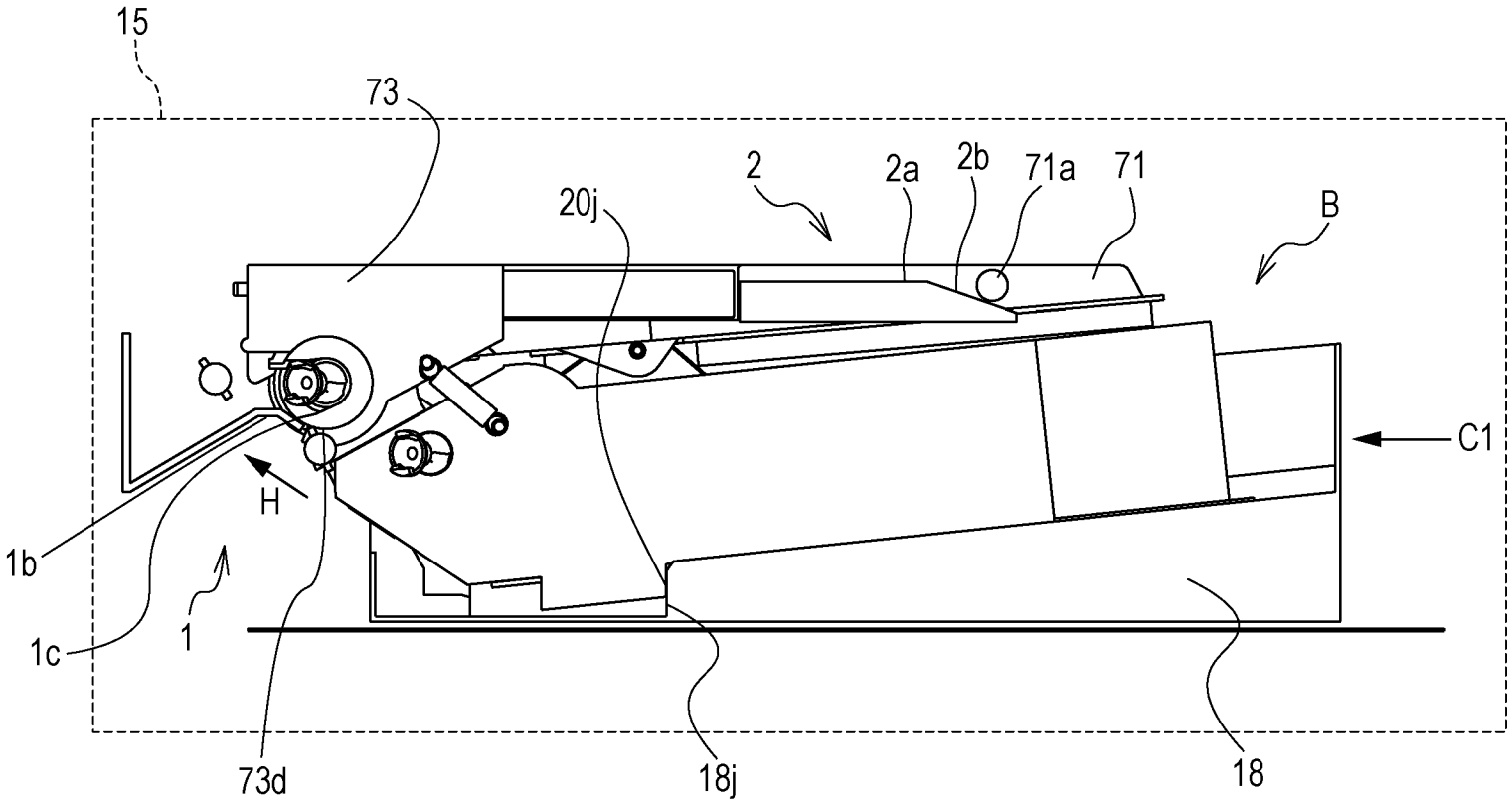
FIG. 32 is a schematic illustration of the main body of the apparatus when moving the tray from a mounting and demounting position to an image forming position in the state in which the process cartridge is mounted on the tray in Example 2.
Figure 33:
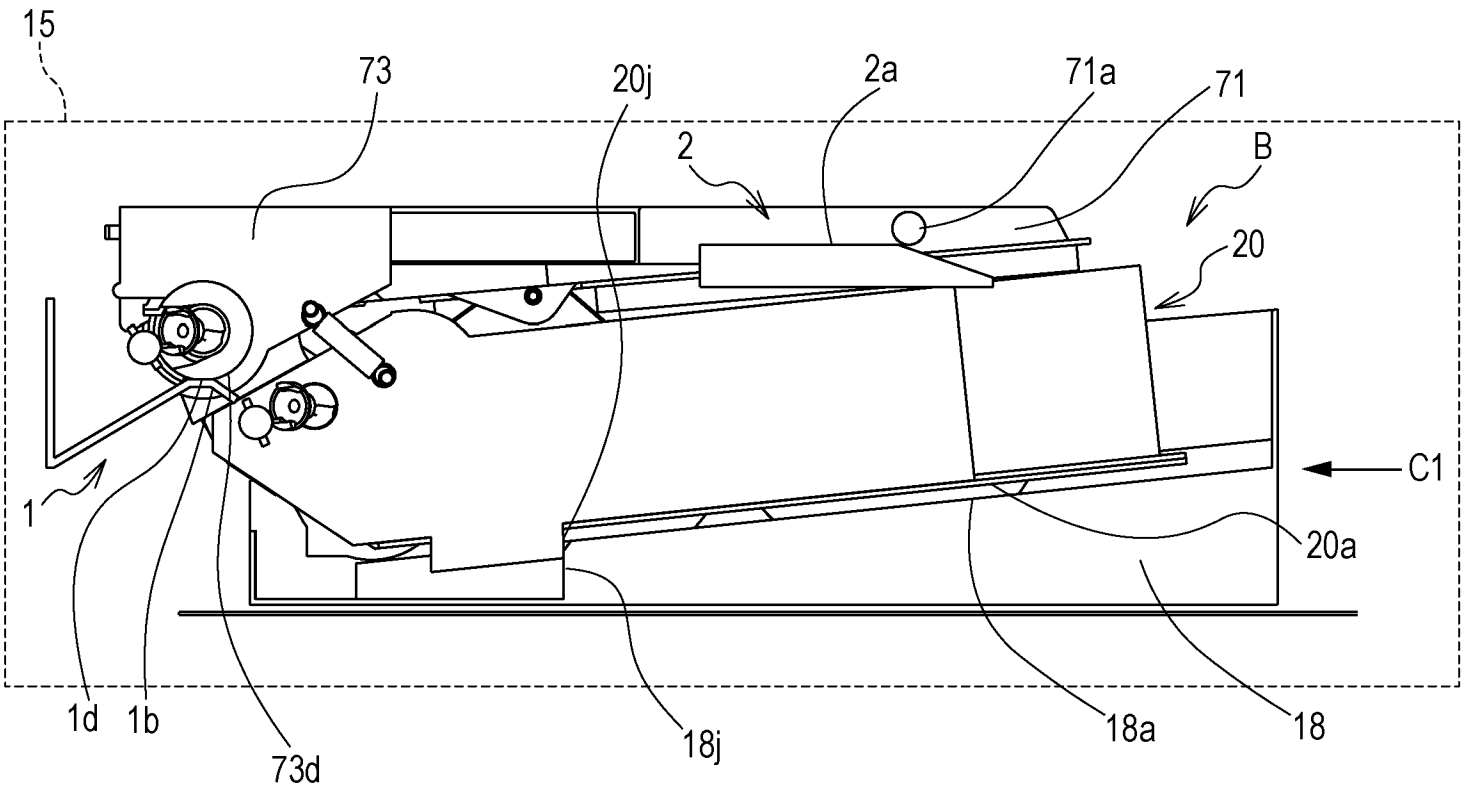
FIG. 33 is a schematic illustration of the main body of the apparatus when moving the tray from the mounting and demounting position to the image forming position in the state in which the process cartridge is mounted on the tray in Example 2.

Mounting of the cartridge B on the main body A will be described first. When the tray 18 is pressed in the direction indicated by the arrow C1 in FIG. 26, the tray 18 moves in the direction indicated by the arrow C1, the first contact surface 18*j* provided on the tray 18 and the first contacted surface 20*j* come into contact, and the process cartridge B moves in the direction indicated by the arrow C1 in FIG. 26 by a force from the tray 18. Since the first contact surface 18*j* and the first contacted surface 20*j* are in contact with each other, if the tray 18 is moved in the direction indicated by the arrow C1 in FIG. 32, the tray 18 moves in the direction C1. A subsequent procedure until the cartridge B is moved in the direction indicated by the arrow C1 to complete mounting of the cartridge B on the main body A is the same as that in Example 1, and thus description is omitted.

Figure 34:
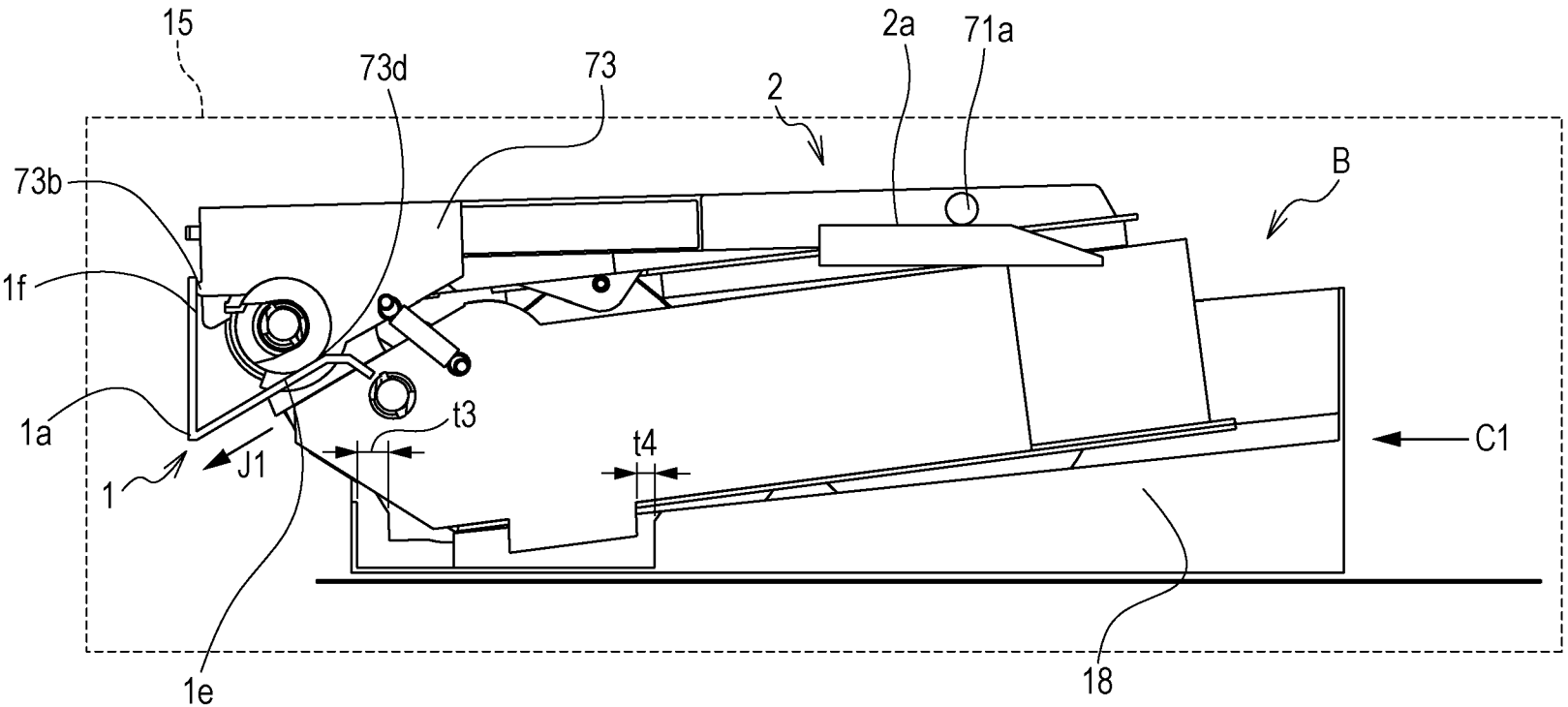
FIG. 34 is a schematic illustration of the main body of the apparatus when the tray is at the image forming position in the state in which the process cartridge is mounted on the tray in Example 2.
Figure 35:
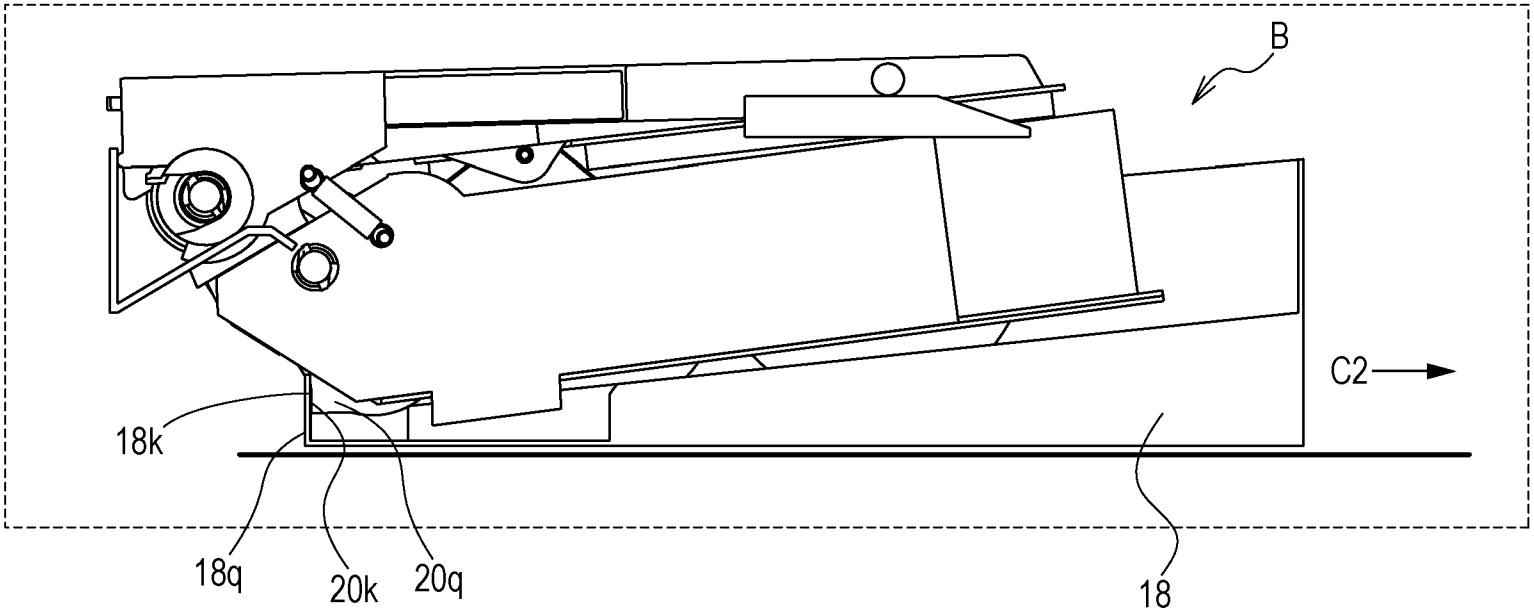
FIG. 35 is a schematic illustration of the main body of the apparatus when moving the tray from the image forming position to the mounting and demounting position in the state in which the process cartridge is mounted on the tray in Example 2.
Figure 36:
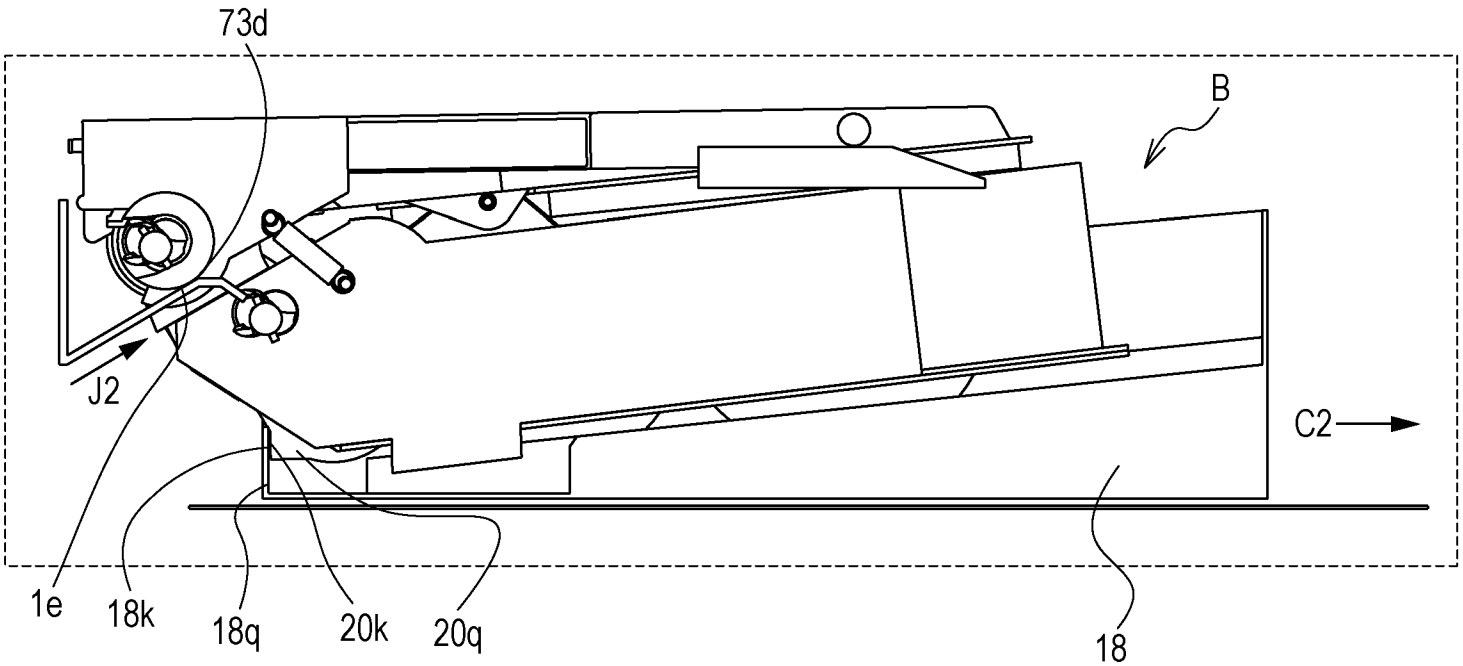
FIG. 36 is a schematic illustration of the main body of the apparatus when moving the tray from the image forming position to the mounting and demounting position in a state in which the process cartridge is mounted on the tray in Example 2.

Next, demounting of the cartridge B from the main body A will now be described. In a state in which mounting of the process cartridge B on the main body A is completed as illustrated in FIG. 34, the gaps t3 and t4 are provided between the first contact surface 18*j* and the first contacted surface 20*j* and between the third contact surface 18*k* and the third contacted surface 20*k*. In this state, the cartridge B is in a state of being positioned by the supporting portion 1*a* and the rotation restricting surface 2*a*. Therefore, as illustrated in FIG. 35, when the tray 18 is moved in the direction indicated by an arrow C2 in FIG. 35, only the tray 18 is moved. In other words, the cartridge B is moved relatively in the opposite direction to the direction indicated by the arrow C2 with respect to the tray 18. Consequently, the gap t3 between the third position-restricted portion 20*q* and the third position restricting portion 18*q* (see FIG. 34) disappear and the third contact surface 18*k* comes into contact with the third contacted surface 20*k*. In addition, as illustrated in FIG. 36, the process cartridge B moves ongoingly in a direction indicated by an arrow J2 in FIG. 36 by the supporting portion 73*d* guided by the supporting surface 1*e* in association with the movement of the tray 18 in the direction C2. A contact relationship between the second and fourth position restricting portions 18*i* and 18*r* and the second and fourth position-restricted portions 20*i* and 20*r* on the non-drive-side is the same as the contact relationship between the first and third position restricting portions 18*h* and 18*q* and the first and third position-restricted portions 20*h* and 20*q* on the drive-side, and thus description will be omitted.

In conclusion, summary of the configuration of the example described thus far is as follows. The position-restricted portions 20*h*, 20*i*, 20*q*, and 20*r* are provided on the developing unit 20 of the cartridge B as a mechanism for limiting the movement of the cartridge B with respect to the tray 18 within a certain range. The tray 18 is provided with the position restricting portions 18*h*, 18*i*, 18*q*, and 18*r* configured to engage the position-restricted portions 20*h*, 20*i*, 20*q*, and 20*r*. In this example, a position on the cartridge B subjected to an impact when mounting the cartridge B on the main body A is different from that when demounting the cartridge B from the main body A. Therefore, the cartridge B having a higher durability than that in Example 1 is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242593 filed Nov. 28, 2014, which is hereby incorporated by reference herein in its entirety.

What is claimed is:

1. An image forming apparatus comprising:

a main body of the apparatus;

a cartridge having a first unit and a second unit pivotably coupled to the first unit; and a cartridge supporting member configured to support and move the cartridge, and configured to be movable with respect to the main body between (i) a mounting and demounting position where the cartridge supporting member is located at an exterior of the main body of the apparatus and is supported by the main body of the apparatus and allowing the cartridge to be mounted to and demounted from the cartridge supporting member and (ii) an image forming position where the cartridge supporting member is located within an interior of the main body to locate the cartridge at a position where the cartridge is allowed to perform formation of an image, wherein the first unit includes a position-restricted portion, and the first unit is located below the second unit in a state in which the cartridge is mounted on the cartridge supporting member, wherein the cartridge supporting member includes a position restricting portion configured to restrict movement of the cartridge with respect to the cartridge supporting member by coming into contact with the position-restricted portion, wherein the position-restricted portion is a projecting portion projecting downward from the first unit in a state in which the cartridge is mounted on the cartridge supporting member, wherein the position restricting portion includes a first contact portion to contact the position-restricted portion while the cartridge supporting member is moving from the mounting and demounting position to the image forming position, and includes a second contact portion to contact the position-restricted portion while the cartridge supporting member is moving from the image forming position to the mounting and demounting position, and wherein, while the cartridge supporting member is supporting the cartridge, at least one of the first contact portion and the second contact portion does not contact the position-restricted portion.

2. The image forming apparatus according to claim 1, wherein a space is formed in the position restricting portion between the first contact portion and the second contact portion for allowing the projecting portion to enter.

3. The image forming apparatus according to claim 1, wherein the position-restricted portion is provided on a bottom surface of the first unit in a state in which the cartridge is mounted on the cartridge supporting member.

4. The image forming apparatus according to claim 1, wherein the second unit includes an image bearing member on which a latent image is formed, and wherein the first unit includes a developer bearing member configured to bear a developer to develop the latent image.

5. The image forming apparatus according to claim 1, wherein the cartridge mounted on the cartridge supporting member is partly located in the interior of the main body of the apparatus when the cartridge supporting member is at the mounting and demounting position.

6. The image forming apparatus according to claim 1, wherein the cartridge supporting member includes a supporting-member-side guide portion configured to come into contact with the cartridge to guide the cartridge to be mounted on the cartridge supporting member.

7. The image forming apparatus according to claim 1, wherein the first contact portion comes into contact with the position-restricted portion when the cartridge supporting member is moved from the mounting and demounting position toward the image forming position, and hence the cartridge is moved at least in a first direction, which is a direction in which the cartridge supporting member moves from the mounting and demounting position toward the image forming position.

8. The image forming apparatus according to claim 1, wherein the second contact portion comes into contact with the position-restricted portion when the cartridge supporting member is moved from the image forming position toward the mounting and demounting position, and hence the cartridge is moved at least in a second direction, which is a direction in which the cartridge supporting member moves from the image forming position toward the mounting and demounting position.

9. The image forming apparatus according to claim 1, wherein the first unit includes at least two of the projecting portions.

10. The image forming apparatus according to claim 1, wherein the cartridge moves from a state of being supported by the cartridge supporting member to a state of being supported by the main body in association with the movement of the cartridge supporting member from the mounting and demounting position to the image forming position.

11. The image forming apparatus according to claim 1, wherein, in a case where the cartridge supporting member is at the mounting and demounting position, the cartridge supporting member supports the cartridge in a state where a gap is formed between the first contact portion and the position-restricted portion.

12. The image forming apparatus according to claim 4, wherein the second unit includes a supported portion, the main body of the apparatus includes a supporting portion configured to support the supported portion and position the image bearing member provided on the second unit at a position which allows formation of an image, and the supported portion is supported by the supporting portion in association with the movement of the cartridge supporting member from the mounting and demounting position to the image forming position.

13. The image forming apparatus according to claim 6, wherein the supporting-member-side guide portion guides the cartridge to be mounted on the cartridge supporting member by coming into contact with the position-restricted portion, and guides the position-restricted portion to a position restricted by the position restricting portion.

14. The image forming apparatus according to claim 6, wherein the supporting-member-side guide portion includes an inclined portion inclining downward in a direction of guiding the cartridge to be mounted.

15. The image forming apparatus according to claim 9, wherein the cartridge supporting member includes at least two of the position restricting portions.

16. The image forming apparatus according to claim 12, wherein the second unit includes a rotation-restricted portion, the main body of the apparatus includes a rotation-restricting portion configured to come into contact with the rotation-restricted portion in a state in which the supported portion is supported by the supporting portion, and the rotation-restricting portion comes into contact with the rotation-restricted portion to suppress the cartridge from rotating about the supporting portion.

17. The image forming apparatus according to claim 13, wherein a step is formed between the supporting-member-side guide portion and the position restricting portion.

18. The image forming apparatus according to claim 16, wherein a position of an upper end of the cartridge supporting member is lower than a contact position between the rotation-restricting portion and the rotation-restricted portion in a state in which the cartridge supporting member is located at the image forming position.

19. The image forming apparatus according to claim 16, wherein the rotation-restricting portion includes:

a main body side guide portion configured to guide the cartridge to be mounted on the main body of the apparatus by coming into contact with the rotation-restricted portion when the cartridge supporting member moves from the mounting and demounting position to the image forming position.

* * * * *